US010174448B2

(12) United States Patent
Capt et al.

(10) Patent No.: US 10,174,448 B2
(45) Date of Patent: Jan. 8, 2019

(54) DEVICE AND METHOD FOR MANUALLY CHANGING A FEED DOG

(71) Applicant: BERNINA International AG, Steckborn (CH)

(72) Inventors: Alain Capt, Rickenbach Sulz (CH); Severin Brunner, Steckborn (CH); Gunnar Schlaich, Constance (DE); Patric Konner, Constance (DE); Andre Stucki, Steckborn (CH); Ioannis Imionidis, Steckborn (CH); Marco Bernegger, Bronschhofen (CH); Chrisoph Frei, Sirnach (CH)

(73) Assignee: BERNINA International AG, Steckborn (CH)

( * ) Notice: Subject to any disclaimer, the term of this patent is extended or adjusted under 35 U.S.C. 154(b) by 0 days.

(21) Appl. No.: 15/966,164

(22) Filed: Apr. 30, 2018

(65) Prior Publication Data

US 2018/0245256 A1 Aug. 30, 2018

Related U.S. Application Data

(63) Continuation-in-part of application No. 15/409,977, filed on Jan. 19, 2017.

(30) Foreign Application Priority Data

May 6, 2016 (CH) ..... 0596/16

(51) Int. Cl.
*D05B 27/22* (2006.01)
*D05B 73/12* (2006.01)

(52) U.S. Cl.
CPC ..... *D05B 27/22* (2013.01); *D05B 73/12* (2013.01); *D05D 2205/02* (2013.01)

(58) Field of Classification Search
CPC ..... D05B 27/02; D05B 27/00; D05B 27/08; D05B 27/22; D05B 73/12
See application file for complete search history.

(56) References Cited

U.S. PATENT DOCUMENTS 1,088,752 A * 3/1914 Smith ..... D05B 27/02 112/314
1,992,781 A 2/1935 Smith
(Continued)

FOREIGN PATENT DOCUMENTS

CH 707972 10/2014
CN 104342853 2/2015
(Continued)

*Primary Examiner* — Danny Worrell
(74) *Attorney, Agent, or Firm* — Volpe and Koenig, P.C.

(57) ABSTRACT

A sewing machine having a device for manually changing a feed dog (10), including the feed dog (10) and a feed-dog holder (30). The feed-dog holder (30) is disposed in an arm bed (103) that is associated with the sewing machine, and the feed dog (10) is receivable in a clearance (31, 81) of the feed-dog holder (30). The feed dog (10) that is located in the clearance (31, 81) has a support face (15) which may be disposed parallel with the surface of a sewn-product support which may contain a needle-hole plate (113) or be configured as a needle-hole plate (113), the sewn-product support and/or the needle-hole plate (113) may at least partially be formed by the surface of the arm bed (103), and the support face (15) may be received in an opening (140) of the needle-hole plate (113). The feed dog (10) is fastenable in the clearance by a fastening element (40, 82, 83) or of a setting element (50) such that the support face (15) is alignable so as to be substantially parallel with the surface of the sewn-product support or of the needle-hole plate (113). The fastening element (40, 82, 83) or the setting element (50) is releasably held in the feed-dog holder (30).

7 Claims, 15 Drawing Sheets

(56) References Cited

U.S. PATENT DOCUMENTS

| | | | | | |
|---|---|---|---|---|---|
| 2,000,073 | A | * | 5/1935 | Goas | A41B 9/001 2/407 |
| 2,771,848 | A | * | 11/1956 | Knaus | D05B 27/02 112/313 |
| 2,906,220 | A | | 9/1959 | Perla et al. | |
| 2,977,911 | A | * | 4/1961 | Moore | D05B 35/02 112/260 |
| 4,391,214 | A | | 7/1983 | Holl et al. | |
| 4,469,039 | A | * | 9/1984 | Marchesi | D05B 27/08 112/313 |
| 4,542,706 | A | | 9/1985 | Hanyu et al. | |
| 4,674,426 | A | * | 6/1987 | Kasuda | D05B 27/08 112/313 |
| 4,691,654 | A | * | 9/1987 | Meier | D05B 27/02 112/303 |
| 4,694,763 | A | * | 9/1987 | Adams | D05B 73/12 112/184 |
| 4,744,319 | A | * | 5/1988 | Rohr | D05B 21/002 112/306 |
| 5,069,152 | A | * | 12/1991 | Wang | D05B 27/08 112/313 |
| 5,101,748 | A | | 4/1992 | Rohr | |
| 5,103,751 | A | * | 4/1992 | Wang | D05B 27/08 112/314 |
| 5,337,689 | A | * | 8/1994 | Tilders | D05B 27/02 112/323 |
| 2006/0283365 | A1 | | 12/2006 | Niizeki et al. | |

FOREIGN PATENT DOCUMENTS

| | | |
|---|---|---|
| CN | 204174392 | 2/2015 |
| CN | 104878522 | 9/2015 |
| DE | 3629514 | 3/1988 |
| DE | 102007026651 | 12/2008 |
| JP | S6293972 | 6/1987 |

* cited by examiner

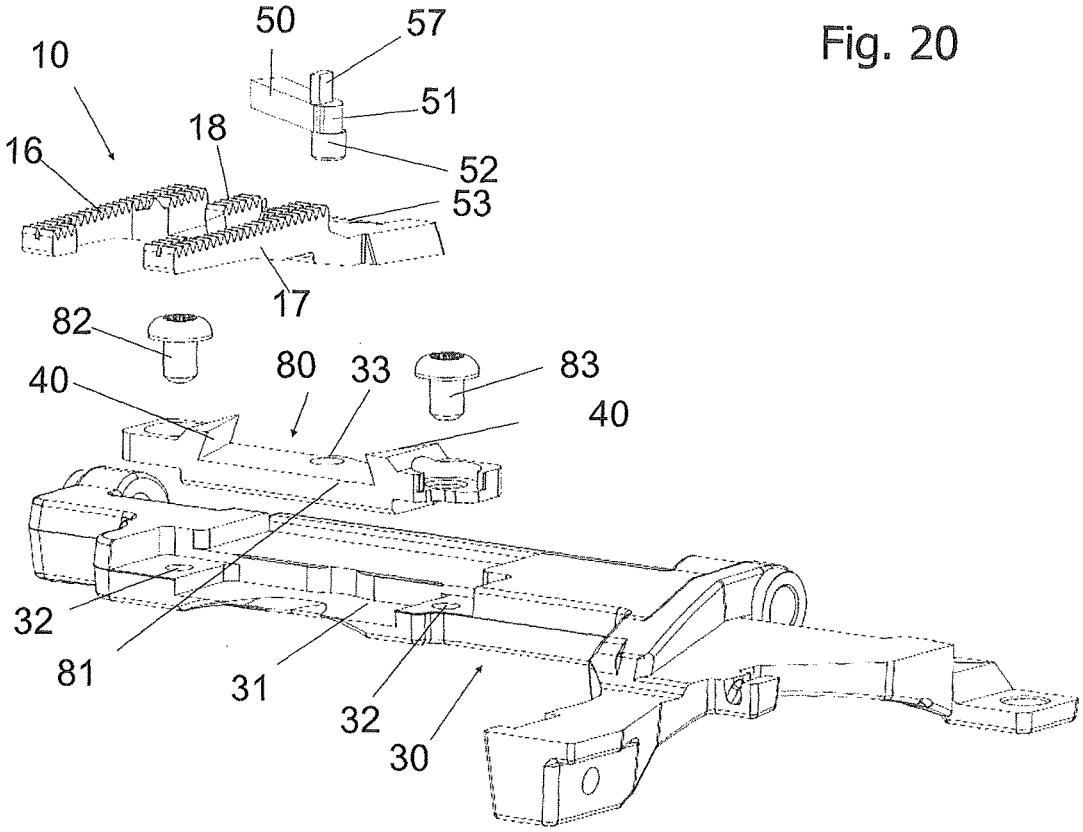
Fig. 20
Fig. 21
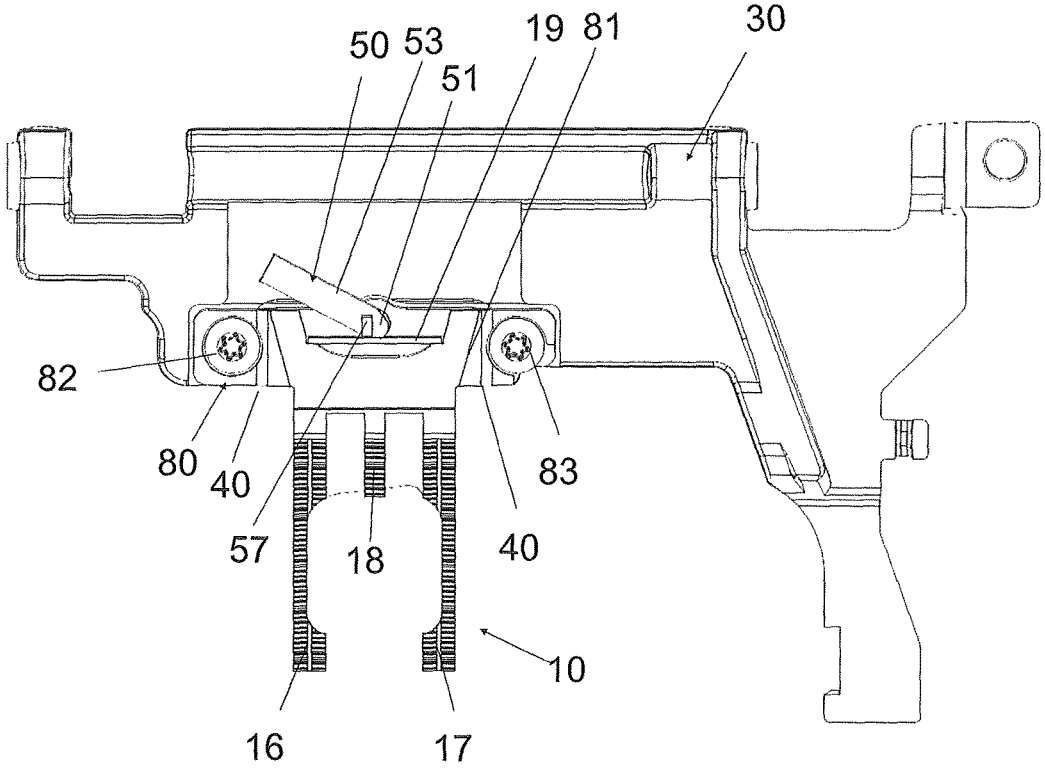

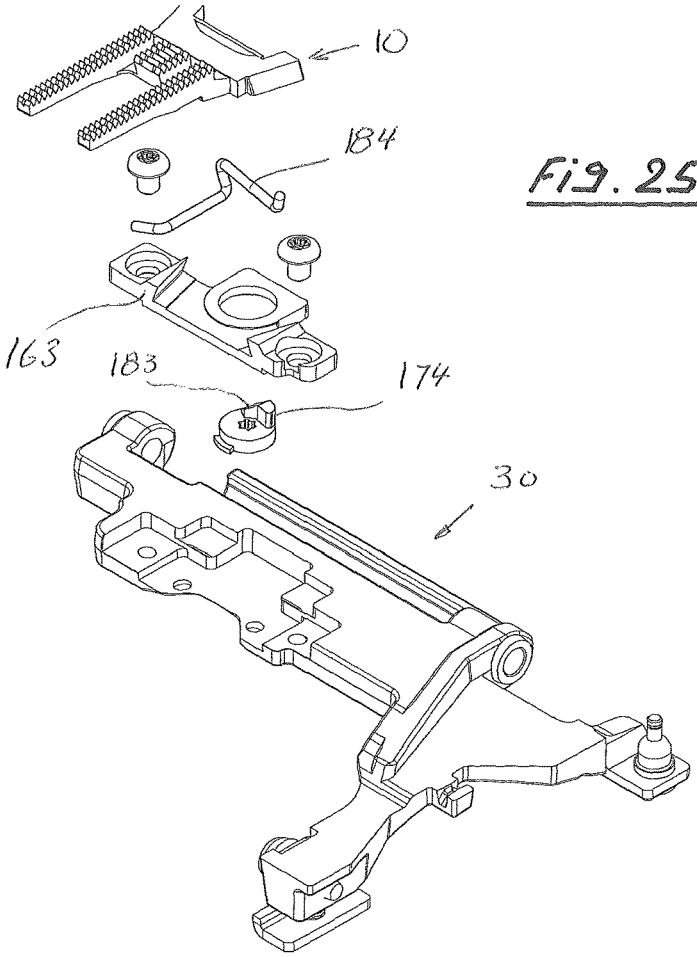
Fig. 25
Fig. 26
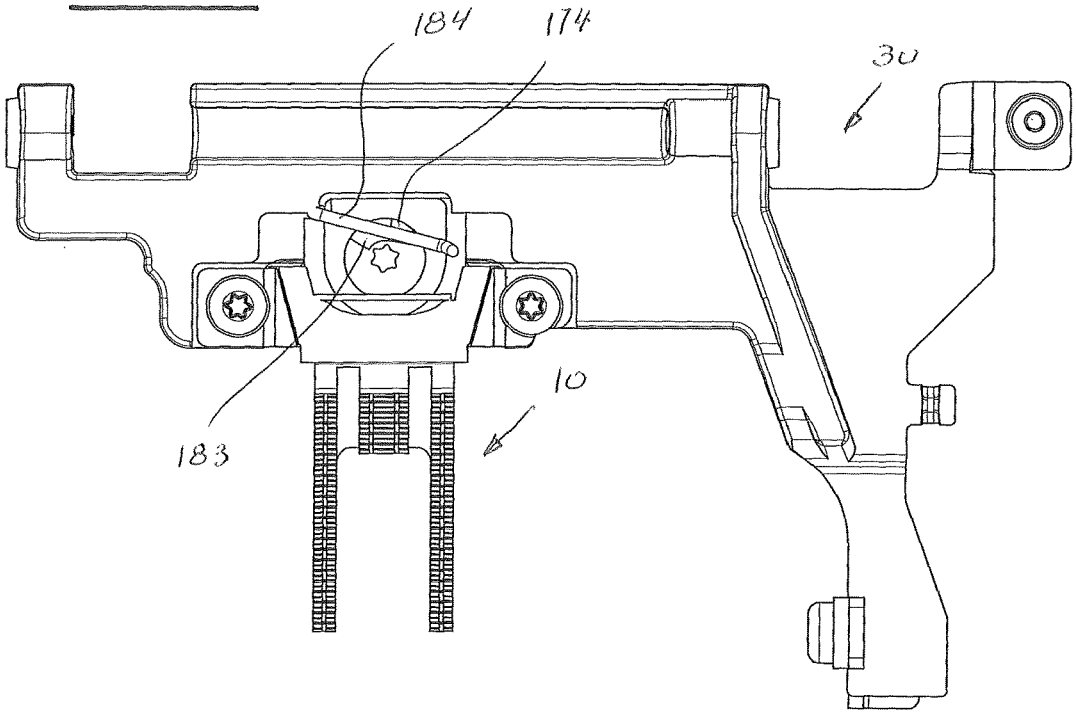

DEVICE AND METHOD FOR MANUALLY CHANGING A FEED DOG

INCORPORATION BY REFERENCE

The following documents are incorporated herein by reference as if fully set forth: U.S. patent application Ser. No. 15/409,977, filed Jan. 19, 2017; and Swiss Patent Application No. 00596/2016, filed May 6, 2016.

BACKGROUND

The subject matter of the invention relates to a device and to a method for manually changing a feed dog for a sewing machine.

Sewing machines each comprise one stitch-forming device for producing seams or embroidery patterns in a planar textile item, hereunder also referred to as the sewn product. The sewing machine has a machine head and an arm bed. The machine head is disposed at the end of an upper arm. A support element adjoins the other end of the upper arm. A so-called arm bed is disposed below the upper arm, so as to run substantially parallel with the upper arm. The arm bed at one end is connected to the support element. The arm bed serves as a support for the sewn product. The machine head contains a needle which is moved up and down, periodically coming into contact with the sewn product. A thread is guided in the needle. The needle pierces the sewn product. Herein, the thread is connected to a bobbin thread which is located below the sewn product, due to which a seam or a pattern is generated. The needle is releasably connected to a needle holder that is disposed at the lower end of a needle bar. The needle bar is moved up and down by a needle-bar drive. The machine head furthermore contains a presser-foot bar that has a lower end, running in a conical or a truncated-conical manner, for coupling and fastening various presser feet. Depending on the type of the sewing job to be carried out, various presser feet are employed. At the commencement of the job, the presser-foot bar together with the presser foot is lowered such that the sole of the presser foot bears on the sewn product. In this position, the sewn product is located between the feed dog and the sole of the presser foot such that the location at which a needle stitch is to take place is precisely defined. The sewn product, prior to the next stitch being performed, may be displaced to the correct position by the feed dog such that a continuous seam or a continuous pattern may be generated in this way. The feed dog thus serves for ensuring that the sewn product is indexed. Of course, the sewn product may also be manually displaced in the plane that contains the sewn product. This operating mode is employed for darning or quilting, for example. Therefore, a sewing machine may be operated according to various operating modes. Therefore, various sewing-machine types that differ in terms of the width of the feed dog used, for example, are offered nowadays. However, the width of the feed dog is established upon purchase of the sewing machine by the purchaser.

However, in order to change over between various operating modes of the sewing machine, it may be meaningful to the user to operate using a feed dog of variable width. Therefore, there is demand for a device by which the user is able to use various feed dogs. A device of this type serves for modifying the width of the feed dog or the shape of the feed dog, so as to extend the employment spectrum of a sewing machine. This sewing machine is particularly destined for the end consumer, that is to say, for use in private households.

Devices for readjusting the feed height are known from CN 10 48 78 522 A, for example, which shows a feed dog that extends in the vertical direction and that is lifted or lowered, respectively, by an eccentric feature that is attached to a shaft that is located in the arm bed, in a manner corresponding to the revolutions of the shaft. A retaining clamp for readjusting the height of a feed dog is known from CN 20 41 74 392 U. Devices for the readjustment of feed indexing are known, for example, from CN 10 43 42 853, from DE 10 2007 026 651 A1, the latter relating to an upper feed dog and to two dissimilar lower-feed readjustment drives for a first and a second lower feed dog. A feed-dog drive having a readjustable indexing direction is known from DE 3 629 514 A1. However, the prior art does not disclose any device or any method, respectively, for changing the entire feed dog, or for setting/modifying the width or the shape of the feed dog, respectively. From U.S. Pat. No. 1,992,781 it is also known for the inclination angle of the feed dog in relation to the sewn-product support to be set, wherein the width of the feed dog remains unchanged, however.

Nowadays, the user has to make a decision in favor of a sewing machine having a respective feed dog already at the point of purchase, that is to say that the width and the shape of the feed dog are permanently established as the purchase decision is made. This decision is typically made by the user by virtue of the comparatively more frequent application, or by virtue of the fundamental requirements that have to be met. Herein, the user, depending on whether the sewing machine is required more for the classic type of sewing application, or for creative sewing, decides in favor of a machine having a comparatively wide or a comparatively narrow feed dog, respectively. Accordingly, the fundamental setting is determined already by the purchase decision, limiting the user in terms of the diversity of applications. Therefore, the sewing machine in the case of many applications is outside the optimal setting in terms of the material feed.

As opposed to the case of industrial sewing machines which typically have a very narrow scope of application, or which typically enable a very small diversity of applications, respectively, and therefore are especially purchased and manufactured for few types of applications, the domestic sewing machine, independently of the purchase decision taken (for example, a width of the feed dog of 5.5 mm or 9.0 mm, respectively), must always achieve at least satisfactory results in all types of applications. For this reason, the mechanical setup, that is to say the unmodifiable basic setting of the sewing machine, so to speak, has always to be seen as a certain compromise, meaning that the material feed is optimized to the maximum for a crude field of application, for example for creative sewing or for classic sewing applications.

There is, therefore, demand for a device for pre-setting the sewing machine to a special application, for example when a special material or a special sewing technique is being used, which device does not have the disadvantages of the prior art.

SUMMARY

The object to be achieved by the invention lies in that the sewing machine, or the material feed respectively, may be set individually to the respective sewing application at any time after purchase. A further object of the present invention lies in providing a device and a method for pre-setting for a sewing machine that enables pre-setting prior to the user using the sewing machine for a special sewing method, such that the sewing machine is optimized for this special sewing method.

A further object of the invention lies in opening up the potential of operating the sewing machine in various operating modes to the user, wherein the user by pre-setting the sewing machine may change from one operating mode to another, the sewing machine being pre-set in an optimal manner for the respective operating mode.

These objects are achieved by a sewing machine comprising a device for manually changing a feed dog, according to one or more features of the invention. Particular exemplary embodiments of the invention are described below and are the subject matter of the claims.

A sewing machine comprises a device for manually changing a feed dog, comprising the feed dog and a feed-dog holder. The feed-dog holder is disposed in an arm bed that is associated with the sewing machine, wherein the feed dog is receivable in a clearance of the feed-dog holder. This clearance, according to one exemplary embodiment, may also be disposed in an insert element that is disposed in the feed-dog holder. The feed dog that is located in the clearance has a support face which may be disposed parallel with the surface of a sewn-product support, wherein the sewn-product support may contain a needle-hole plate or be configured as a needle-hole plate. The sewn-product support and/or the needle-hole plate may at least partially be formed by the surface of the arm bed. The feed dog has a base face that is disposed so as to be opposite the support face, wherein in the assembled state the base face at least partially bears on a base area of the clearance. The sewn-product support may comprise a needle-hole plate, for example. In particular, the surface of the arm bed may contain a needle-hole plate, or be configured as a needle-hole plate. The support face is in particular received in an opening of the needle-hole plate. The feed dog is fastenable in the clearance by a fastening element or of a setting element such that the support face may be aligned so as to be substantially parallel with the surface of the sewn-product support or of the needle-hole plate. The fastening element or the setting element is releasably held in the feed-dog holder.

The opening may have a greater length than the feed dog or than the web of the feed dog that is guided through the opening, such that the position of the feed dog in relation to the opening is variable. This means that the position of the feed dog in the indexing direction of the sewn product may be modified. Alternatively or additionally thereto, a feed dog having a larger or a smaller length dimension may be used. The feed-dog area that is available for feeding the sewn product may thus be modified. Due to this, swapping and replacing feed dogs having dissimilar length dimensions is enabled.

According to one exemplary embodiment, the clearance may have at least one lateral edge which delimits the base area at the periphery thereof, wherein the feed dog is at least partially received by the lateral edge of the clearance.

According to one exemplary embodiment, the opening may have a greater width than the feed dog, such that the width of the feed dog is variable. On account thereof, swapping and replacing feed dogs having dissimilar width dimensions is enabled.

Of course, the preceding exemplary embodiments may be combined in such a manner that both feed dogs having dissimilar length dimensions and feed dogs having dissimilar width dimensions, or feed dogs having dissimilar length and width dimensions, may be employed. The matching needle-hole plate is also used so as to correspond to the selected feed dog.

According to one exemplary embodiment, the feed dog in the position thereof in relation to the clearance may be settable and/or lockable by the setting element. In particular, the setting element may comprise an eccentric feature, wherein the eccentric feature is guided on a pin or is configured as part of a pin that is held in a recess of the feed dog, and is held in a threaded bore in the feed-dog holder. According to one exemplary embodiment, the setting element may comprise a locking element.

According to one exemplary embodiment, the fastening element comprises a screw. In particular, the fastening element cannot protrude beyond the surface of the feed dog. This means that the height of the fastening element at maximum corresponds to the support face that is formed by the surface of the feed dog. According to an alternative exemplary embodiment, the fastening element comprises a threaded bolt and/or a nut. According to a further exemplary embodiment, the fastening element comprises a guide rail. According to a further exemplary embodiment, the fastening element comprises a bolt.

According to one exemplary embodiment, the fastening element is at least partially held in the clearance of the feed-dog holder and/or in an insert element. Various insert elements may also be employed. For example, the depth of the clearance of the insert element may be varied such that feed dogs of dissimilar thicknesses may be employed. Various insert elements in combination with feed dogs of dissimilar length dimensions and/or width dimensions and/or thicknesses may also be employed. Thickness is understood to be the dimension of the feed dog in the Z-direction in the installed state. The length dimension is understood to be the maximum dimension of the feed dog or of the support face that may at least be formed by the webs in the indexing direction of the sewn product, that is to say in the Y-direction. The width dimension is understood to be the maximum dimension of the feed dog in the X-direction.

According to one exemplary embodiment, the feed dog is positionable in the clearance by a fixing element or of a locking element. The fixing element contains a magnet or a ferromagnetic region, for example. The locking element may be rotatably disposed in the feed-dog holder.

The various feed dogs may be swapped by the user in person, so as to be able to select the optimal mechanical setup for the application, or the suitable feed-dog width and shape.

By virtue of the high requirements set for the material feed, or for the alignment of the feed dog, respectively, in the case of modern sewing machines each feed dog has to be individually aligned ex-works during assembly, so as to be able to guarantee an optimal material feed. In the case of the alignment of the feed dog the focus above all is on the flanks of the feed dog lying parallel with the clearing in the needle-hole plate, or so as to be perpendicular to the arm bed of the sewing machine, respectively, so as to be able to guarantee a uniform material feed without distortion. Since experience and skill in the art is required for aligning the feed dog, such as is not typically available to an average user, apart from the pure changeover device, a device for aligning the individual feed dogs has also to be provided.

According to one exemplary embodiment of the invention, the screw connection is described independently of the device for aligning the feed dogs. Herein, in the simplest embodiment, the various feed dogs are fastened to the feed-dog holder by two screws. A disadvantage of this comparatively simple embodiment lies in that the screws may drop into the opened sewing machine or may otherwise be lost when the individual feed dogs are being changed. Proceeding therefrom, a further embodiment provides a securing element. This securing element in particular serves for securing the two screws to the feed dog so that said screws cannot be lost or drop into the machine, respectively. Should a screw drop into the sewing machine, or into the arm bed, respectively, during a changeover of feed dogs, this upon starting up of the machine may lead to significant damage, for example in the region of the stitch-forming means, for example of the thread cutter.

A securing element herein, in the simplest form, is configured as an element from the group of chains or cables, and ensures that the screws cannot be lost. This embodiment has the disadvantage that the chain or the cable is conjointly rotated during fastening of the screws and is thus wound around the screw, this potentially leading to complications during fastening. The screw-securing feature may likewise be embodied as a conjointly rotating securing feature, in that the latter by way of a plastics part is attached to the screw head by way of a snap-fit connection, or is rotatably fastened to the upper end of the screw shaft.

Since the feed-dog holder is a comparatively fast-moving part that is drivable at speeds of up to 1500 rpm, and accordingly has to be able to perform 1500 motion sequences per minute, said feed-dog holder has to be configured so as to be comparatively light, which is why the latter is typically made from aluminum. This, in the case of the screw-fittable embodiment described above, results in the additional set of problems of the feed-dog holder being able to be damaged in a comparatively rapid manner by way of defective fitting during fastening of the feed dog. This damage is created, for example, when the steel screw is screwed into the aluminum of lesser strength in a flawed manner, for example by way of canting, due to which the thread in the feed-dog holder is damaged. This results in the feed dog no longer being able to be screwed on correctly. Consequently, this may lead to a breakdown of the machine, or to maintenance work being required.

In order for the disadvantages of the embodiment described above to be overcome, a further embodiment provides that in the ex-works assembly two threaded bolts are screwed into the feed dog and are permanently secured or fixed, respectively, using a securing element which contains a securing element from the group of the Loctite screw securing features, for example, or Tuflok screws. The individual feed dogs during a changeover are not fastened to the feed-dog holder by way of a screw, as has been described above, but are screw-fitted by way of a nut at the upper end of a threaded bolt. The risk of any damaging maloperation may be significantly reduced by way of material matching, and by way of guiding the nut in relation to the bolt. In a manner similar to that of the preceding embodiment, the nuts are likewise secured on the feed dog, so as to prevent the latter from being lost or being able to drop into the machine. This securing feature in the preferred embodiment is implemented by way of a sheet-metal plate that is fastened to the feed dog.

In order to ensure that the feed dog during changeover is aligned as has been described above, said feed dog is aligned by way of an interference fit between the feed dog and the associated fastening element, on the one hand. The freedom of movement in the Z-direction and the X-direction is suppressed or at least restricted by this alignment. Herein, the longitudinal direction of the arm bed is defined as the X-direction, the Y-direction corresponding to the transverse direction of the arm bed, or to the indexing direction of the sewn product, respectively. The Z-direction is directed so as to be normal to the support face, that is to say, in the direction of the lifting and lowering movement of the sewing needle, respectively.

The restriction of the freedom of movement in the Y-direction, or the final alignment of the feed dog, respectively, is performed by the interaction between the fastening element and an eccentric device which in the optimal case lies proximate to the second fastening means. The alignment of the feed dog, as has been described above, herein is performed for each machine by way of the eccentric device upon ex-works assembly.

By virtue of the chosen production tolerances it is ensured that the face on which the eccentric device aligns the feed dog has a sufficiently precise shape and position in order for the various feed dogs to be aligned in a sufficiently precise manner on the eccentric feature, so as to ensure that the requirements set for the material feed, or for positioning the feed dog, respectively, are met.

In the case of sufficiently precise shape and position tolerances of the feed dog not being able to be achieved during production, mutual pairing of the various feed dogs is performed. This pairing is performed by way of a common processing step. This processing step provides that the face on which the eccentric device aligns the feed dog is finally machined in a conjoint manner in one tool.

Independently of the final processing step, the alignment is preferably performed by way of a lateral recess or on the rear side of the feed dog. The advantage of the lateral recess lies in that the feed dog is self-aligning during the changeover. In the case of the alignment on the rear side of the feed dog, attention has to be paid by the user that either said feed dog does indeed bear on the eccentric device, or is pulled towards the latter or is held on the latter by way of a magnet, for example. Moreover, a fixing element, for example a magnet, is integrated in the feed-dog holder as an assembly aid to the user, by way of which the feed dog is temporarily held in the clearance. This ensures that the feed dog may be assembled using both hands, and that not one hand is occupied with holding the feed dog.

According to one exemplary embodiment, fastening and aligning are implemented in a mutually separate manner, in that also the fitting bolt and the eccentric feature are integrated in the feed-dog holder so as to be separate from the fastening elements. To this end, the interference fit is positioned by way of a bolt that is integrated in the feed-dog holder, and by way of a further bore that is provided in the feed dog. It would be likewise conceivable that the eccentric feature is not positioned on an external face or recess of the feed dog, but likewise by way of a separate bore in the feed-dog holder.

As in the previous embodiment, the freedom of movement in the Z-direction and the X-direction in this present embodiment is fixed or restricted, respectively, by an interference fit in the feed dog and the associated fastening element. The further alignment of the feed dog in this exemplary embodiment is performed by a template or by an alignment web that is attached to the former. The alignment is performed in that the alignment web is introduced from above between the one flank of the feed dog and the edge of the needle-hole plate, prior to the latter being finally screw-fitted. The needle-hole plate contains a cut-through in which the feed dog moves during sewing. In order to ensure that the flank of the feed dog bears on the alignment web of the template, either a recess, a slide device having an entrainment part, or similar, is provided on the opposite side, so that the feed dog may be manually pushed in the direction of the alignment web. According to an alternative exemplary embodiment, one magnet each may be placed in the center or in each case at the commencement and at the end of the alignment web, so as to ensure that the feed dog bears on the alignment web. In order to ensure that the feed dog does bear on the alignment web, the former may be fastened as has been described above. By virtue of the restricted space conditions, a special needle-hole plate could be employed such that the space between the flank of the feed dog and the edge of the needle-hole plate is utilized.

In one further exemplary embodiment, the feed dog is not aligned on the needle-hole plate, but on the gap between the feed dog and the feed-dog holder.

In one further exemplary embodiment, the feed dog is not aligned on an alignment web of a template that is introduced from above, but on an edge of a special needle-hole plate. Herein, in a manner similar to that of the alignment web, the feed dog by way of manual compression or by way of a magnetic device is pushed against an edge of the needle-hole plate while the former is being fastened to the feed-dog holder by way of the fastening elements.

According to one variant, the feed dog may be placed into a needle-hole plate in which the former is held by way of at least one magnet, and is positioned by way of depressions, for example. This needle-hole plate is subsequently placed on top, and the feed dog may be fastened by way of holes or bores in the needle-hole plate. Herein, the needle-hole plate that is utilized for sewing may subsequently be readjusted so as to ensure that the former sits in an optimal manner, or does not rub.

According to one further exemplary embodiment, a presser foot that bears on a flank of the feed dog, for example, or engages in toothing of the support face of the feed dog, for example, is utilized for aligning, so as to align the respective feed dog. According to one further exemplary embodiment, the fixing element, that is to say the template or the alignment means, for example, for aligning the feed dog may bear on the flank of said feed dog, and/or may engage by way of the toothing, and/or may be attached to the needle bar.

According to one exemplary embodiment, the alignment of the feed dog is performed by way of a zigzag stitch of the sewing machine. To this end, the feed dog is initially fixed in a temporary manner, for example is loosely screw-fitted, and is positioned on the feed-dog holder in the X-direction by way of the interference fit. Positioning in the Y-direction is performed in that the sewing needle aligns the flanks of the feed dog by way of the respective zigzag stitch. Once this has been performed, said feed dog may be tightly screw-fitted. In order for the alignment to be performed, in a manner analogous to the sewing procedure, a hook on a rotating or oscillating gripper acquires the loop that is formed during the reverse stroke of the sewing needle, guides said loop around the gripper having the bobbin thread coil mounted therein, thus looping around the bobbin thread. The thread lifter then pulls the needle thread upward, the needle likewise moving upward, until the knot lies at the desired location on the lower side of the sewn product or within the latter. The sewing needle is then displaced by way of the needle bar in the Y-direction by an amount of $\Delta Y$, so as to perform a stitch that in relation to the first stitch is offset in the X-direction and the Y-direction, due to which a zigzag shape is created. The feed dog indexes the material between the stitch holes of the sewing needle. The spacing of the first stitch from the second stitch, when measured in the Y-direction, that is to say the stitch width of the zigzag stitch, corresponds to the width of the spacing of the first arm of the feed dog from the second arm of the latter. Thus, by carrying out a zigzag stitch, the feed dog may be exactly aligned.

The sewing procedure described serves only for replacing and aligning a feed dog if and when a different type of seam is produced. In the case of every type of seam formation, the stitch formation remains unchanged, the technique of stitch formation therefore not needing or having to be described per se.

In the case of the present embodiment, the respective feed dogs are not fastened to the feed-dog holder by way of a usual screw connection, but are guided and locked in a guide. Herein, the guide is not limited to the guide systems described hereunder. First, the linear guide is described independently of the fastening of the respective feed dogs. The linear guides described herein may lie both vertically as well as horizontally in relation to the material-feeding direction, that is to say run in the Z-direction or the Y-direction.

In a first embodiment, the feed dog is guided in a settable linear guide. Herein, the feed dog is configured as a slide, and the feed-dog holder is configured as a lower or guide part, respectively, and is set by way of a setting element between the slide and the guide part. In this way, the individual feed dogs may be set to the respective machine ex-works during assembly, so as to ensure said feed dogs meet the requirements set for the material feed. The guides may contain an element from the group of dovetail guides, or of encompassing linear guides.

In one further embodiment, the feed dog is guided by two guides in the feed-dog holder. In order for the system per se not to be configured in a statically over-determined manner, one guide is configured as a fixed support, and one guide is configured as a floating support.

Locking of the feed dog may be performed both independently from the various configurations of the guide elements, as has been described above, likewise in a screw-fittable manner by way of at least one screw. Since the objective of the guided feed-dog changing device is that of a user-friendly embodiment, the screw-fittable variant is not preferable.

A snap-fitting device may lock the feed dog in a terminal position when said feed dog is being introduced. The snap-fitting mechanism herein is locked by a respective clearance that is disposed laterally on the feed dog, and by a catch, communicating with said clearance, in the feed-dog holder or in the guide part. The snap-fitting mechanism may be unlocked for changing.

According to one variant, the feed dog may be locked by a tiltable locking mechanism. Herein, the comparatively minor necessary force that is required for holding the feed dog may be applied by a spring. Locking is performed by a locking element, for example, which may contain an element from the group of bolts, or plates, and which is guided or held, respectively, by the feed dog and the feed-dog holder, or the guide part. The locking element herein may be guided both vertically as well as horizontally.

According to one exemplary embodiment, locking of the feed dog is performed by a quick-clamp mechanism which may be configured in a manner similar to that of a quick-clamp mechanism for bicycles. Herein, the feed dog is fixed or clamped, respectively in the Z-direction by the tensioner when the feed dog is being locked.

The types of locking that have been listed above herein may be both manually driven as well as automatically, for example electrically, driven, activated by the user, or may apply the holding force and/or maintain the holding force. Furthermore, both the tiltable locking mechanism as well as the quick-clamp mechanism may serve as a substitution for the screw connection of one of the preceding embodiments, as long as the locking mechanism is embodied in two parts, a first part being embodied as an interference fit, that is to say without play, and a second part being embodied with a certain amount of play, so as to be able to guarantee the alignment by way of the eccentric device.

In this embodiment, the feed dog is likewise embodied in multiple parts. The shape and the width, respectively, herein are modified in that extensions of the feed dog that are dissimilarly embodied or molded, respectively, may be plug-fitted onto an existing part of the feed dog. The extension of the existing feed dog herein may be fastened either by way of a click-fit connection on the lower side of the existing part, or by way of a cotter pin or of a screw connection.

In a further embodiment, the feed dog does not come to bear directly on the feed-dog support, but a fastening and alignment element is placed between the feed dog and the feed-dog support and ex-works is connected in a non-recurring manner to the feed-dog support. A tapered dovetail groove is configured on the fastening element. As a counterpart thereto, a dovetail wedge, which by way of a small displacement path in the dovetail bears on the fastening element and thus fixedly holds the feed dog so as to be exactly positioned, is configured on the feed dog. The feed dog is held in the push-fitted position by means of a simple rotatable eccentric securing element. In order for the feed dog to be replaced by a feed dog having a dissimilar width, consequently only one disk as the securing element has to be rotated, and the feed dog can thereafter be retrieved from the dovetail groove by being displaced within the latter by a few millimeters.

The greatest advantage in relation to the prior art lies in that by way of a changing device of the feed dog, presetting of the sewing machine is always at an optimum for the respective application, or may be set to an optimum, respectively. Accordingly, this means that the configuration of the sewing machine is modified, due to which an increased number of degrees of freedom for setting the sewing machine is available to the user. For this reason, the sewing machine is no longer set in a limited manner to the crude application range, that is to say to either a classic sewing application or to creative sewing, for example, but especially to the desired application. Furthermore, the configuration may be optimized not only for the application but also in terms of the material to be sewn.

BRIEF DESCRIPTION OF THE DRAWINGS

The invention will be explained in more detail by means of illustrated exemplary embodiments. In the drawings:

FIG. 20 shows a perspective illustration of a fifth exemplary embodiment according to the invention, in an exploded illustration;

FIG. 21 shows a view of the fifth exemplary embodiment from above.

FIG. 25 shows a perspective illustration of a sixth exemplary embodiment according to the invention, in an exploded illustration, having an additional securing element;

FIG. 26 shows a plan view of the exemplary embodiment according to FIG. 25 (individual parts assembled)

DETAILED DESCRIPTION OF THE PREFERRED EMBODIMENTS

Figure 1:
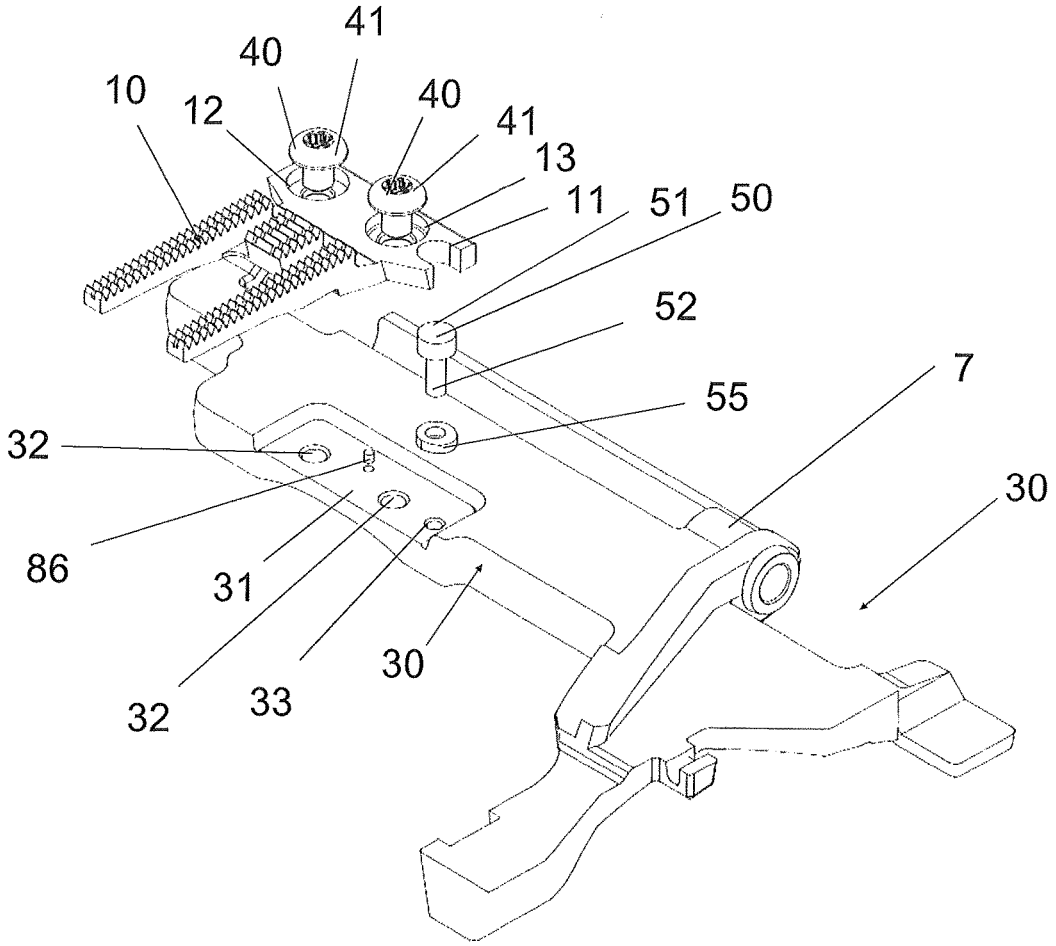
FIG. 1 shows a perspective illustration of a first exemplary embodiment according to the invention, in an exploded illustration.
Figure 15:
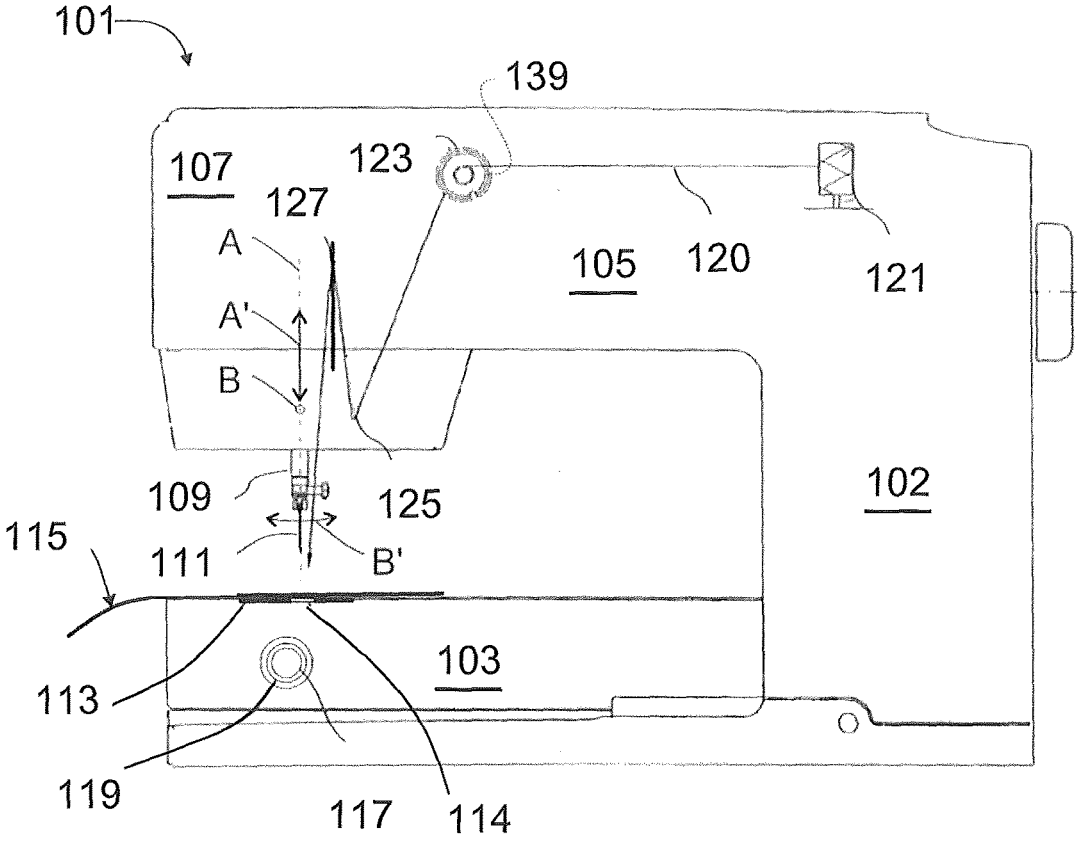
FIG. 15 shows a schematic illustration of a sewing machine.

A device for manually changing a feed dog 10 for a sewing machine, according to FIG. 1, comprises the feed dog 10 and a feed-dog holder 30. For the sake of improved clarity, the illustration of details of the sewing machine has been dispensed with in the figures, since said details are well known from the prior art, see CH707972 A1, for example, which is incorporated herein by reference. The feed dog 10 is receivable in a clearance 31 of the feed-dog holder 30. The feed-dog holder 30 is disposed in an arm bed 103 of the sewing machine 101, as is shown in FIG. 15. The feed dog 10 is fastenable in the clearance 31 by a fastening element 40, wherein the fastening element 40 is releasably held in the feed-dog holder 30. The fastening element 40 may comprise a screw 41, for example.

According to the embodiment in FIG. 1, various feed dogs 10 may be fastened to the feed-dog holder 40 by way of two screws 41.

A setting element 50, by way of which the feed dog 10 in the position thereof in relation to the clearance 31 is settable, is also illustrated in FIG. 1. The setting element 50 according to FIG. 1 is configured as a pin which has a head end 51 and a neck 52. The head end 51 has a larger diameter than the neck 52. The neck 52 may have an external thread. The neck 52 can at least be partially held in a bore 33 that is attached in the clearance 31. The bore 33 may be configured as a threaded bore. An eccentric disk 55 may be disposed on the neck 52. The eccentric disk 55 is received in a mounting 11 of the feed dog 10, if and when the feed dog 10 is placed into the clearance 31.

Figure 9:
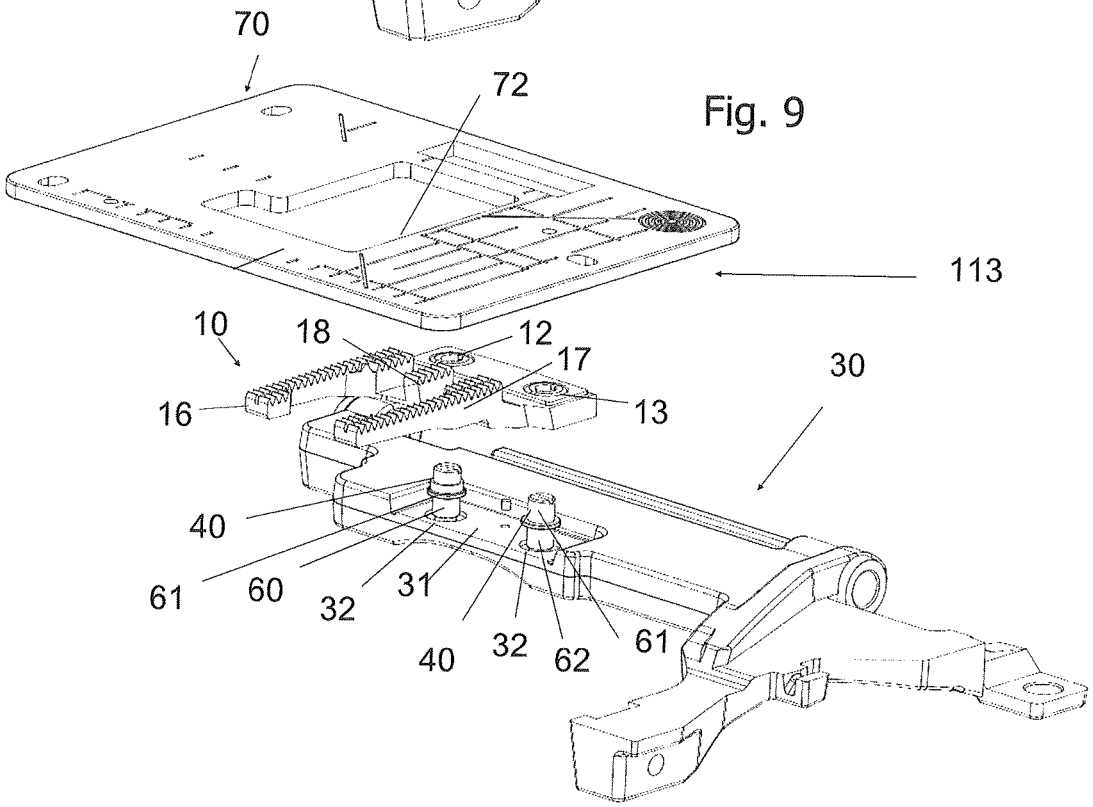
FIG. 9 shows a perspective illustration of the second exemplary embodiment according to the invention, in an exploded illustration, having a further variant of the holding element.

Instead of a separate eccentric disk 55, the head end 51 could also be configured as an eccentric feature, this not being illustrated in the drawings. The position of the feed dog 10 in the clearance 31 is thus establishable, depending on the position of the eccentric disk 55. The head end 51 may have a receptacle element for an activation key. According to a further exemplary embodiment, the head end 51 may have a rough profile or a fluted feature, enabling the head end 51 to be manually rotated so as to move the eccentric disk 55 to the desired position, on account of which a fine adjustment of the feed dog 10 may be performed. The feed dog 10 may thus be aligned depending on the contour that is located in the needle-hole plate 113 of the sewing machine 101. A needle-hole plate 113 of this type is shown in FIG. 9, for example.

If and when two fastening elements 40 are used, one of the fastening elements 40 may be received without play, that is to say by way of an interference fit, in the bore 12 of the feed dog 10, and the respective other fastening element 40 may be received without an interference fit, that is to say with play, in the associated bore 13 of the feed dog 10.

A fixing element 86 which may be configured as a magnetic element, in particular as a magnetic pin, for example, may be used for fixing the feed dog 10 in the correct position, prior to the blocking of the feed dog 10 being performed by the fastening element or elements 40.

Figure 2:
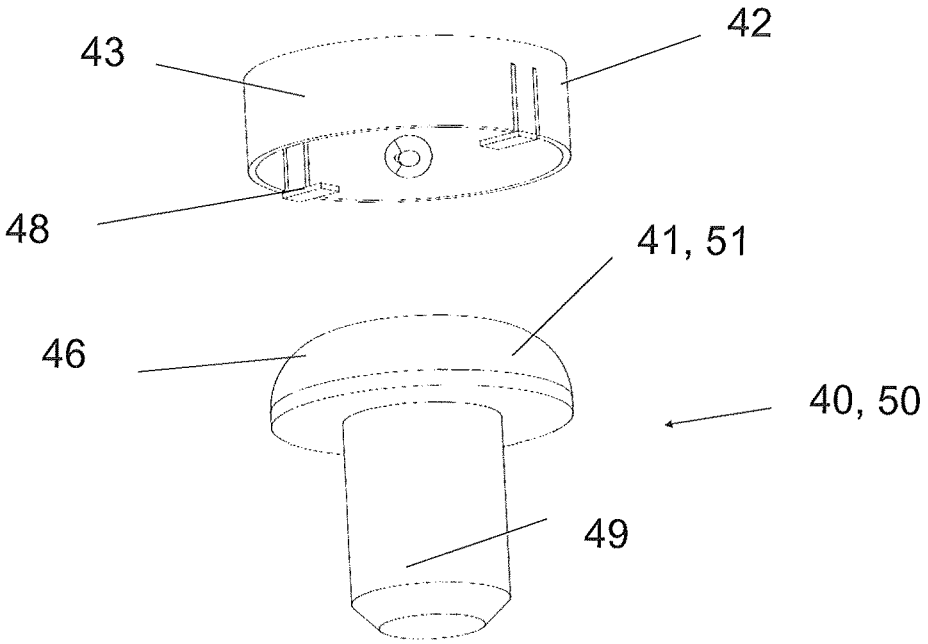
FIG. 2 shows a view of the screw-securing feature according to FIG. 1.
Figure 3:
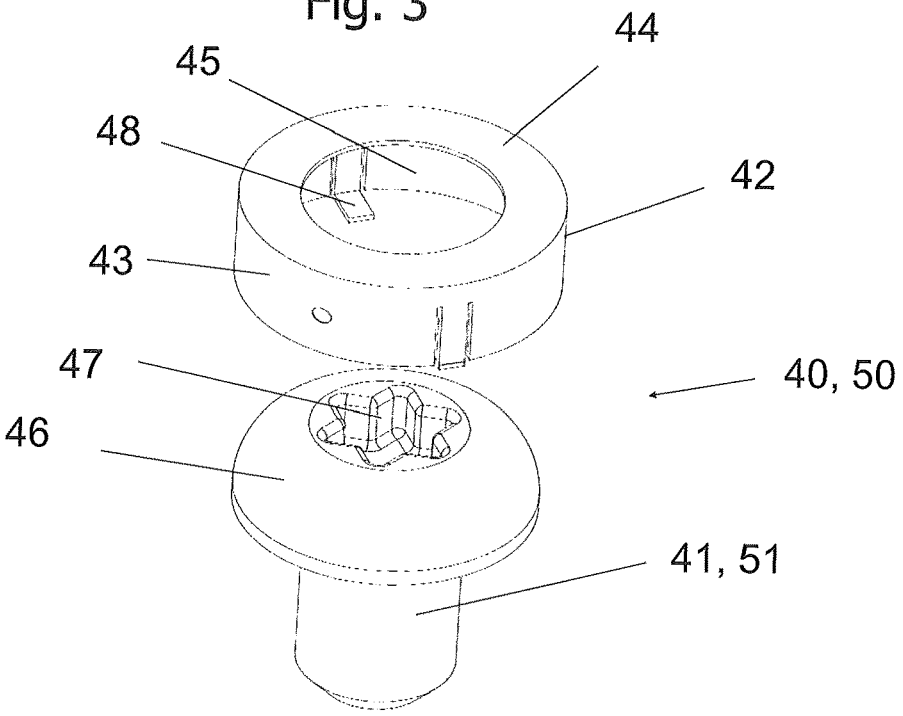
FIG. 3 shows a second view of the screw-securing feature according to FIG. 1 or FIG. 2.

FIG. 2 and FIG. 3 in an exemplary manner show the screw 41 of FIG. 1, and a screw-securing feature 42. The second screw of FIG. 1 may have a screw-securing feature of the same type. The screw-securing feature 42 according to this exemplary embodiment is configured as a thin-walled cylinder 43 having a planar cover face 44. The cover face 44 has a central opening 45 through which the screw head 46 protrudes. The screw head 46 has a receptacle 47 for an activation key. By way of the opening 45 in the cover face 44 of the thin-walled cylinder 43 it is guaranteed that the user may loosen or tighten the screw 41 at any time.

The thin-walled cylinder 43, at that end that is opposite the cover face 44, has a tab 48, The tab 48 in the assembled state encompasses the screw head 46.

As is illustrated in FIG. 1, the screw head 46, optionally together with the screw-securing feature 42, bears on a ledge of a respective bore in the feed dog. The screw-securing feature is not illustrated in FIG. 1. The thin-walled cylinder has a bore or a hole through which a rope or a cable, respectively, is guided, said rope or cable, respectively, being likewise fastened in the feed-dog holder or in the feed dog, in order for the screw to not be able to drop into the sewing machine.

The securing element herein is configured such that the rope may conjointly rotate and is not wound around the screw.

The screws 41 have a screw neck 49. The screw neck 49 in the assembled state protrudes through the bore in the feed dog 10, and is held in a threaded bore 32 that is disposed in the clearance 31. To this end, the screw neck 49 has an external thread (not illustrated in the drawings).

Figure 4:
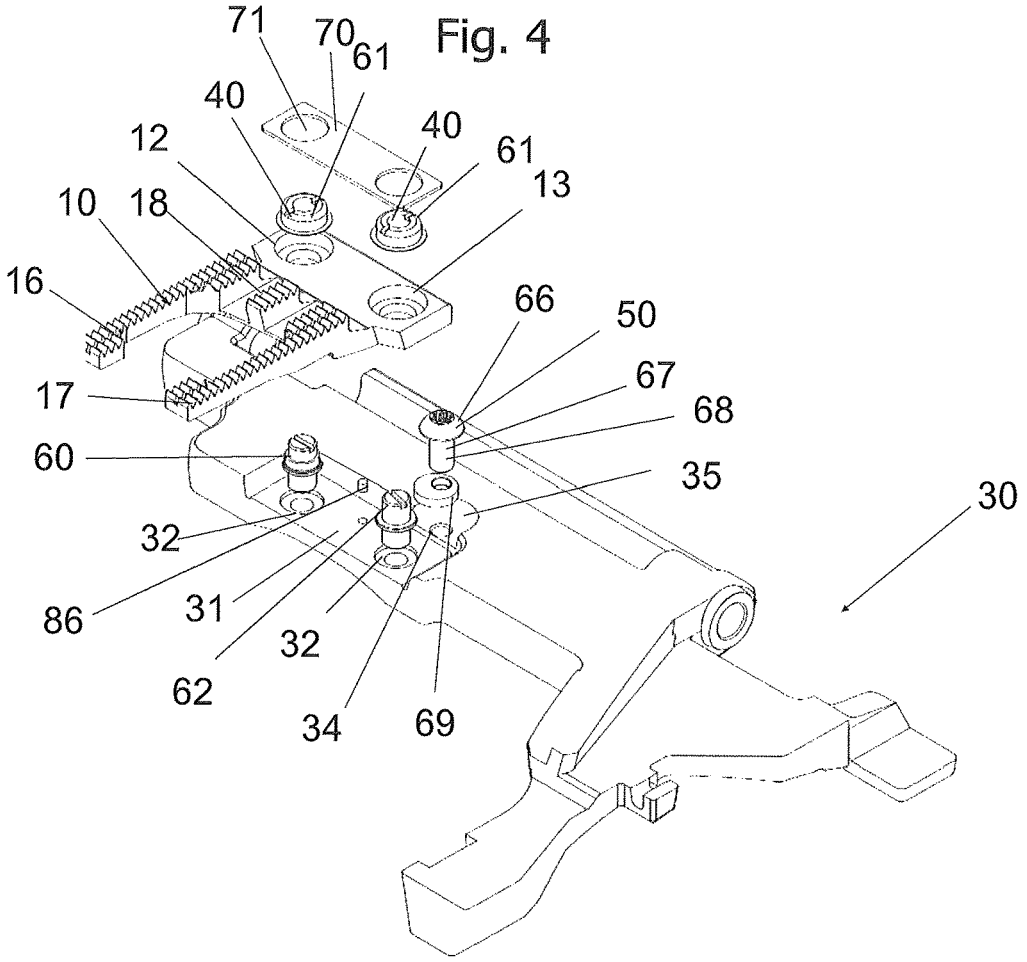
FIG. 4 shows a perspective illustration of a second exemplary embodiment according to the invention, in an exploded illustration.

A device for manually changing a feed dog 10 for a sewing machine 101, according to FIG. 4, comprises the feed dog 10 and a feed-dog holder 30. The feed dog 10 is receivable in a clearance 31 of the feed-dog holder 30. The feed-dog holder 30 is disposed in an arm bed 103 of the sewing machine 101, as is shown in FIG. 15. The feed dog 10 is fastenable in the clearance 31 by a fastening element 40, wherein the fastening element 40 is releasably held in the feed-dog holder 30. The fastening element 40 may comprise a threaded bolt 60 and an associated nut 61.

According to the embodiment as per FIG. 4, various feed dogs 10 may be fastened to the feed-dog holder 30 by way of two threaded bolts 60 and the associated nuts 61.

A setting element 50, by way of which the feed dog 10 in the position thereof in relation to the clearance 31 is settable, is also illustrated in FIG. 4. The setting element 50 according to FIG. 4 is configured as a set screw 65 which has a screw head 66 and a screw neck 67. The screw head 66 has a larger diameter than the screw neck 67. The screw neck 67 may have an external thread 68. The screw neck 67 may at least be partially held in a threaded bore 34 which is attached to a mounting 35 in the feed-dog holder 30. An eccentric disk 69 may be disposed on the screw neck 67. The eccentric disk 69 is received in the mounting 35 of the feed-dog holder 30 if and when the feed dog 10 is placed into the clearance 31 and bears on the feed dog 10. The feed dog 10 may be finely adjusted in the clearance 31 by way of the position of the eccentric feature of the eccentric disk.

Instead of a separate eccentric disk 69, the screw head 66 could also be configured as an eccentric feature, this not being illustrated in the drawings. The position of the feed dog 10 in the clearance 31 is therefore establishable depending on the position of the eccentric disk 69. The screw head 66 may have a receptacle element for an activation key. According to one further exemplary embodiment, the screw head 66 may have a rough profile or a fluted feature, enabling the screw head 66 to be manually rotated so as to move the eccentric disk 69 to the desired position, on account of which the fine adjustment of the feed dog 10 may be performed. The feed dog 10 may thus be aligned so as to correspond to the contour that is located in the needle-hole plate 113 of the sewing machine 101. A needle-hole plate 113 of this type is shown in FIG. 9, for example. The needle-hole plate shown in FIG. 9, by virtue of the large recess, may not be used for sewing but serves only as an alignment template.

If and when two fastening elements 40 are used, one of the fastening elements 40 may be received without play, that is to say by way of an interference fit, in the bore 12 of the feed dog 10, and the respective other fastening element 40 may be received without an interference fit, that is to say with play, in the associated bore 13 of the feed dog 10. Alternatively or additionally thereto, two bores 12 of the same type may be provided in the feed dog, and the first threaded bolt 60 may be embodied with an interference fit, and the second threaded bolt 62 may be embodied without an interference fit. Alternatively or additionally thereto, a holding plate 70 which has two bores 71 may be provided, the diameter of the latter corresponding substantially to the external diameter of the nuts. The holding plate may be configured as a sheet-metal holding plate, in particular.

Figure 5:
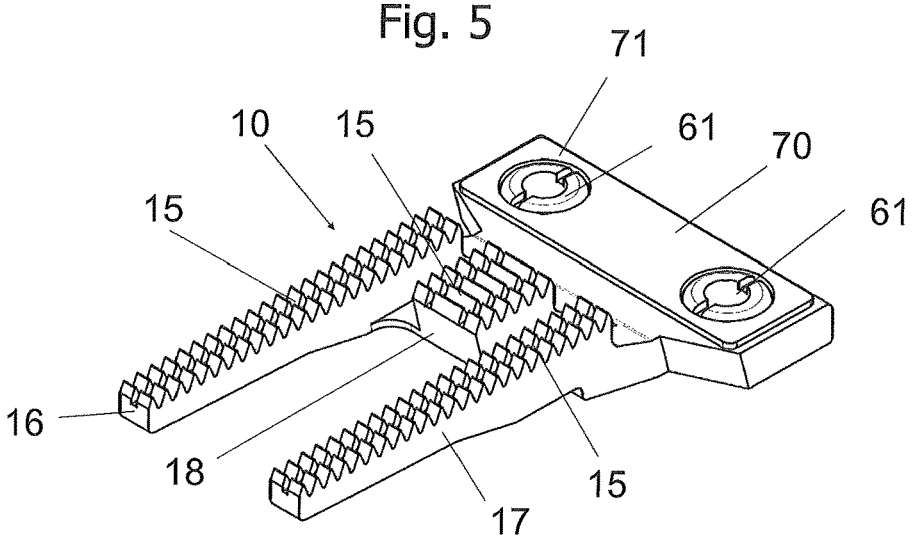
FIG. 5 shows a detail of a variant of a feed dog for employment in the exemplary embodiment according to FIG. 4.

FIG. 5 shows a feed dog 10 of another construction mode, which may be attached to the feed-dog holder 30 that is illustrated in FIG. 4. The feed dog 10 has a first external web 16 and a second external web 17. The first external web 16 and the second external web 17 have a constant web width, and have a substantially identical length. A central web 18 is disposed between the first external web 16 and the second external web 17. The central web 18 has a larger web width than the first 16 and the second external web 17. The central web 18 has a shorter length than the first 16 and the second external web 17. The first 16 and the second external web 17 and also the central web 18 define the support face 15 on which the sewn product bears. The first 16 and the second external web 17 and the central web 18 have a plurality of transverse flutes that improve the adhesion of the sewn product on the feed dog, enabling the sewn product to be acquired by the feed dog and to be moved in the indexing direction.

The feed dog in FIG. 4 differs from the feed dog illustrated in FIG. 5 in that the central web 18 has a web width that at least partially is smaller than the web width of the first 16 and the second external web 17. Furthermore, the first 16 and the second external web 17 have a web width that when viewed across the web length is variable.

The first 16 and the second external web 17 and the central web 18 may be interconnected. Since the central web 18 is shorter than the first 16 and the second external web 17, the first 16 and the second external web 17 form two arm elements that delimit a void. This void enables the sewing needle, upon having pierced the sewn product, to be able to be guided by the feed dog, such that the needle thread that is conjointly guided by the sewing needle may configure a loop that can be acquired below the feed dog by a hook of the gripper, and may be connected to the bobbin thread.

Figure 6:
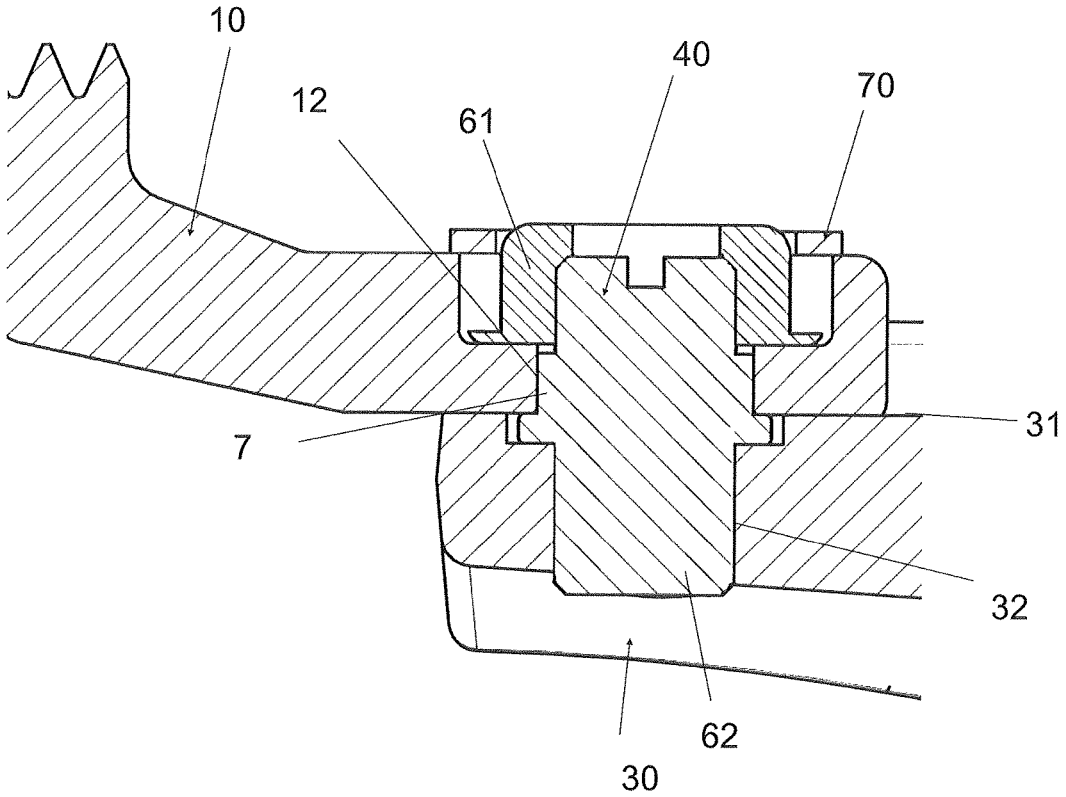
FIG. 6 shows a section through the fastening element of the exemplary embodiment shown in FIG. 4, in the installed state.

FIG. 6 shows a section through the fastening element 40 of the exemplary embodiment that is shown in FIG. 4, in the installed state. The fastening element 40 by way of which the feed dog 10 is fastenable in the clearance 31 is illustrated in a section. The fastening element 40 according to FIG. 6 is configured as a threaded bolt 62 which by a flange is held at a defined screw-in depth in the bore 32 of the feed-dog holder 30. A region having a larger external diameter than the external diameter of the thread that fits into the bore 32 extends above the flange. The region having the larger external diameter is designed so as to match the internal diameter of the bore 12 of the feed dog 10, such that the feed dog is fitted by way of an interference fit. An external thread which receives the internal thread of the nut 61 adjoins above the interference-fit region. The nut bears on a ledge that is located in the bore 12. The bore 12 is configured as a stepped bore. The lower part of the stepped bore has a smaller internal diameter that the upper part of the stepped bore. The upper part of the stepped bore thus receives the nut 61 that captively holds the feed dog on the feed-dog holder 30. A holding element 70 which is configured as a holding plate may be additionally provided.

Figure 7:
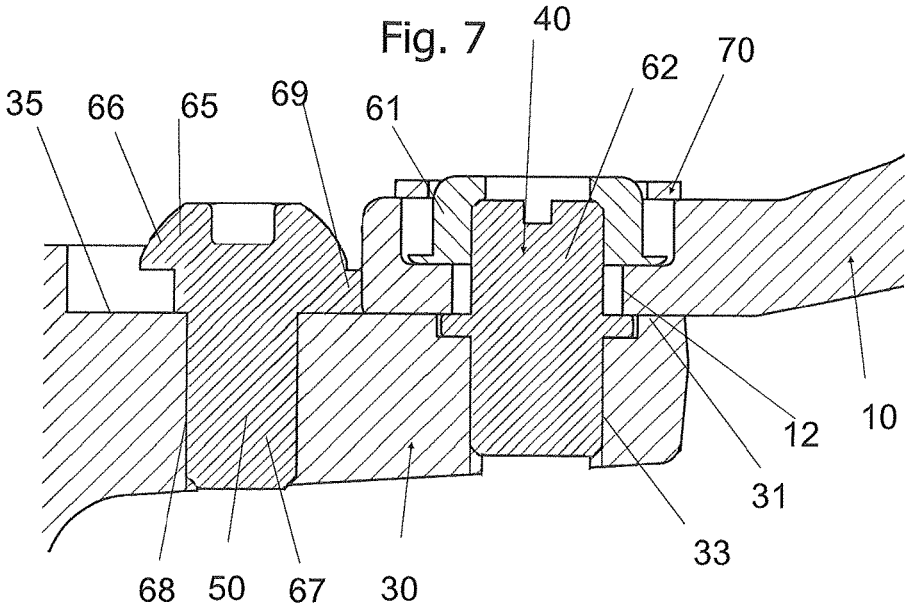
FIG. 7 shows a section through the fastening element of the exemplary embodiment shown in FIG. 4, in the installed state.

FIG. 7 shows a section through the fastening element 40 of the exemplary embodiment that is shown in FIG. 4, in the installed state. The fastening element 40 by way of which the feed dog 10 is fastenable in the clearance 31 is illustrated in a section. The fastening element 40 according to FIG. 6 is configured as a threaded bolt 62 which by a flange is held at a defined screw-in depth in the bore 32 of the feed-dog holder 30. A region having the same external diameter as the external diameter of the thread that fits into the bore 32 extends above the flange. The region above the flange has a smaller diameter than the internal diameter of the bore 12 of the feed dog 10, such that the feed dog is fitted having play. An external thread that receives the internal thread of the nut 61 adjoins above the receptacle region for the feed dog 10. The nut bears on a ledge that is located in the bore 12. The bore 12 is configured as a stepped bore. The lower part of the stepped bore has a smaller internal diameter than the upper part of the stepped bore. The upper part of the stepped bore thus receives the nut 61 that captively holds the feed dog on the feed-dog holder 30. A holding element 70 which is configured as a holding plate may be additionally provided.

The setting element 50 by way of which the feed dog 10 in the position thereof in relation to the clearance 31 is settable is also illustrated in a section in FIG. 7. The setting element 50 according to FIG. 7 is configured as a set screw 65 which has a screw head 66 and a screw neck 67. The screw head 66 has a larger diameter than the screw neck 67. The screw neck 67 may have an external thread 68. The screw head 67 may at least partially be held in a threaded bore 34 that is attached in a mounting 35 in the feed-dog holder 30. An eccentric disk 69, which in this exemplary embodiment is configured so as to be integral with the set screw 65, may be disposed on the screw neck 67. The eccentric disk 69 is received in the mounting 35 of the feed-dog holder 30, if and when the feed dog 10 is placed into the clearance 31, and bears on the feed dog 10, that is to say in particular on the rear wall of the feed dog 10. The feed dog 10 in the clearance 31 may be finely adjusted by way of the position of the eccentric feature of the eccentric disk 69.

Figure 8:
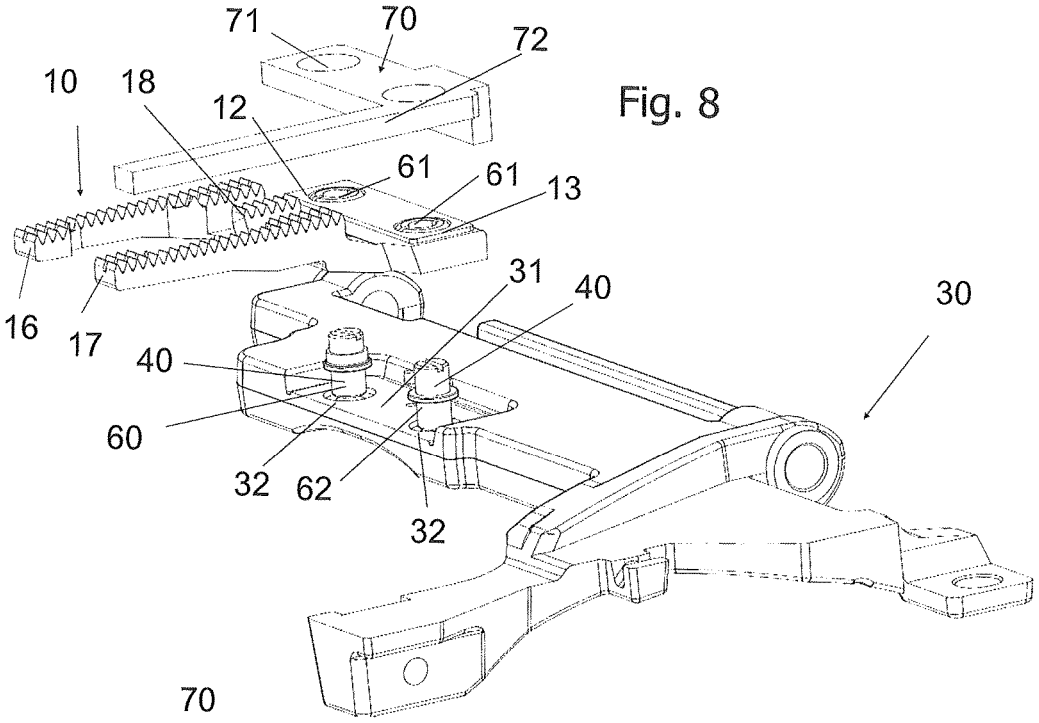
FIG. 8 shows a perspective illustration of the second exemplary embodiment according to the invention, in an exploded illustration, having a variant of the holding element.

FIG. 8 shows a perspective illustration of the second exemplary embodiment according to the invention, in an exploded illustration, having a variant of the holding element. Reference is made to the description relating to FIG. 4 for those elements that have already been described in the context of FIG. 4. Said elements have the same reference signs as have been used in FIG. 4. The setting element 50 is configured as a template 72 which is a component part of the holding element 70. The template is configured as a web element which may equalize the width differential of the feed dog. The template bears on the second external web 18 of the feed dog 10. The template 72 is removed upon alignment of the feed dog, or prior to the commencement of sewing, and serves only for the alignment. The alignment is performed in that the rear face of the template 72 is positioned into a clearance of the feed-dog holder 30. Thereafter, the feed dog or the external web 18 is pushed against this lateral face of the template and by way of the two holes is screw-fitted to the feed-dog holder 30. Once the feed dog has been screw-fitted, the template 72 is removed and the matching needle-hole plate (not shown) is inserted.

FIG. 9 shows a perspective illustration of the second exemplary embodiment according to the invention, in an exploded illustration which shows a further variant of the holding element 70 which in this exemplary embodiment is formed by the needle-hole plate 113. The needle-hole plate has a clearance which is adapted to the contour of the feed dog 10, such that the feed dog is exactly positioned in the needle-hole plate 113. Here too, the needle-hole plate 113 serves only as a template for the alignment. The feed dog 10 is loosely screw-fitted. The needle-hole plate 113 is inserted and is positioned in the arm bed by way of the usual mounting. Thereafter, the feed dog 10 or the external web 17, respectively, is pressed onto one side and screwed tight. Thereafter, the needle-hole plate 113 is replaced by a needle-hole plate suitable for sewing.

Figure 10:
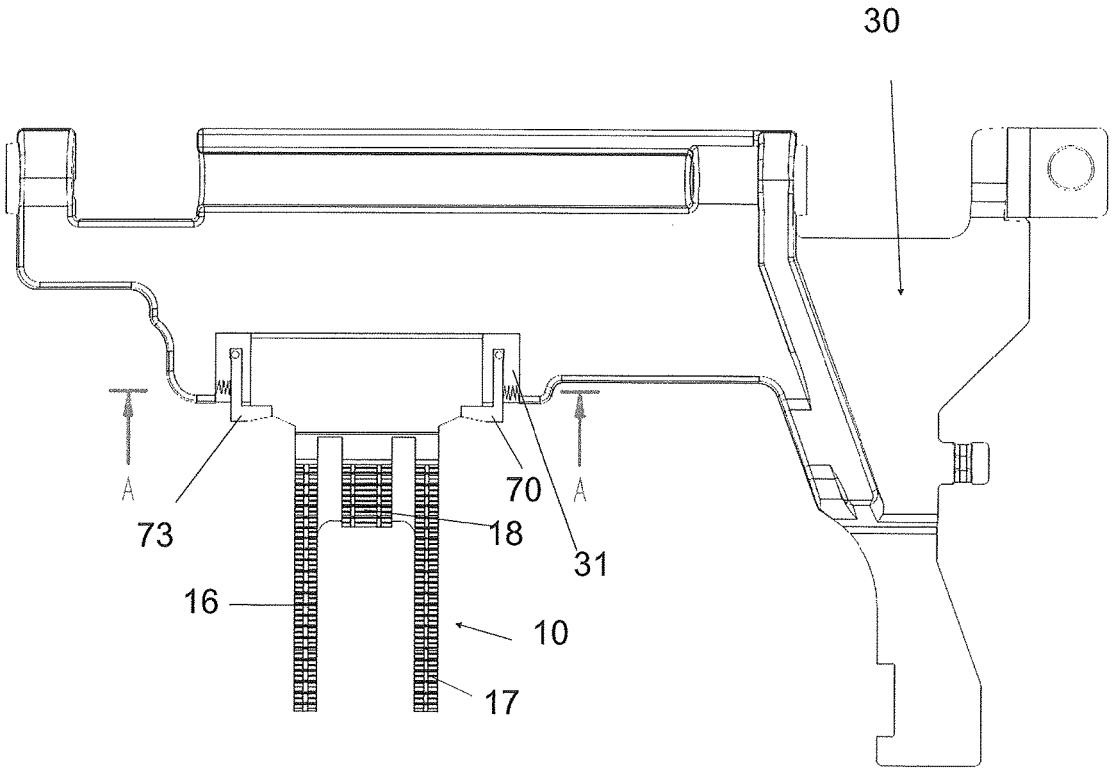
FIG. 10 shows a view of a third exemplary embodiment from above.

FIG. 10 shows a view of a third exemplary embodiment from above, in which the feed dog 10 is held in the feed-dog holder 30 by way of a fastening element 40 which is configured as a guide rail. The feed dog is held in the position thereof by a holding element 70. The holding element 70 is configured by a snap-fit element 73. The snap-fit element 73 captively holds the feed dog on the guide rail. The snap-fit element 73 in this exemplary embodiment is configured as a gripper arm which in the locking position thereof is held by a spring element.

Figure 11:
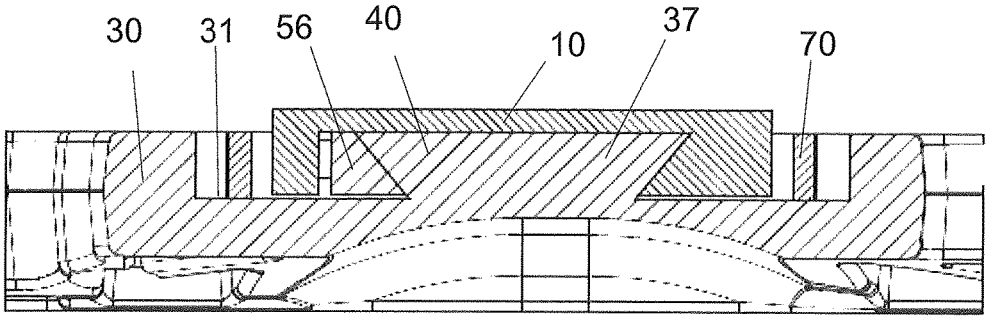
FIG. 11 shows a section through the feed dog and the associated linear guide.

FIG. 11 shows a section through the feed dog and the associated guide rail 37 which is configured as a linear guide. The guide rail 37 contains a setting element 50. The setting element 50 may be configured as a set screw 56 which enables adjustment of the feed dog in the X-direction, that is to say in the direction transverse to the indexing direction.

Therefore, the feed dog 10, according to this first embodiment of the fastening element 40, is guided in a guide rail 37 which is configured as a settable linear guide. Herein, the feed dog 10 is configured as a slide, and the feed-dog holder 30 is configured as a lower or guide part, respectively, and is set by way of a setting element 50 between the slide and the guide part. In this way, the individual feed dogs 10 may be set ex-works during assembly to the respective sewing machine 101, so as to ensure that said feed dogs 10 meet the requirements set for the material feed. The guide rail 37 may contain an element from the group of dovetail guides, or of the encompassing linear guides.

Figure 12:
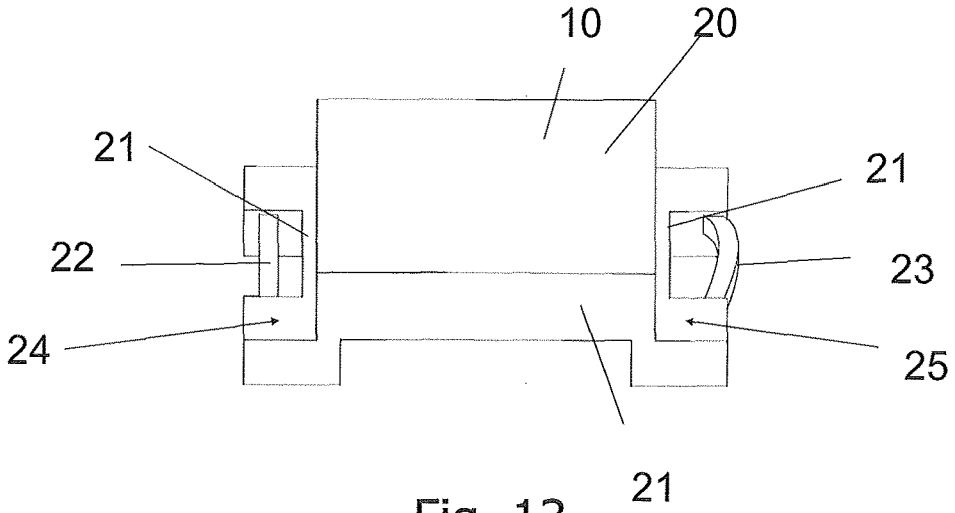
FIG. 12 shows a view of a variant of the linear guide in the Y-Z plane.

FIG. 12 shows a view of a guide element 20 for a feed dog 10. The feed dog 10 contains the guide element 20, or may be fastened to the guide element 20. The guide element 20 has a main body which contains a guide slide such that a linear guide is configured. The guide slide contains a first clamping element 22 which enables fixing of the feed dog 10 in the Z-direction, and a second clamping element 23 which allows fixing of the feed dog 10 in the Y-direction and the Z-direction.

Two clamping elements may be provided in particular, wherein one of the clamping elements enables the adjustment in the X-direction, and the respective other clamping element enables the adjustment in the X-direction and the Z-direction. Thus, that clamping element that performs the adjustment in the X-direction is employed as a floating support, and that clamping element that performs the adjustment in the X-direction and the Z-direction is employed as a fixed support. The feed dog, by way of the clamping element 22, 23, is not ultimately secured in the operating position in the sense of being held therein, but is merely braced, and is finally held or secured, respectively, in the operating position by a securing element (not illustrated).

The guide element 20 has an arm element 24, disposed on the left side in FIG. 12, and an arm element 25, disposed on the right side. Each of the arm elements 24, 25 supports a support element 21 which is C-shaped in the cross section and in each of which one clamping element 22, 23 may be received. According to one exemplary embodiment (not illustrated) the clamping element 22, 23 may be integrated in the main body 5 or in the guide slide 7.

Figure 13:
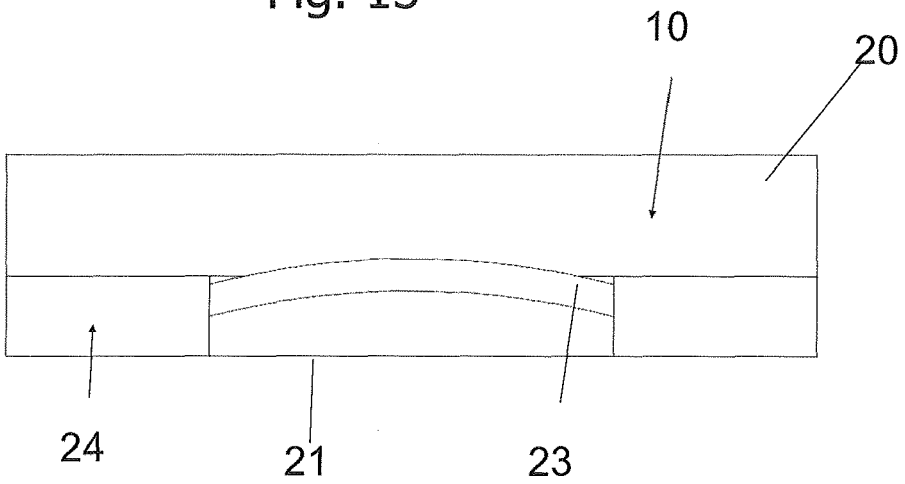
FIG. 13 shows a side view of a variant of the linear guide in the X-Z plane.

FIG. 13 shows a side view of the guide element 20 of the feed dog 10 in the X-Z plane. In the present exemplary embodiment, the support element 21 contains a groove in which one of the clamping elements 22, 23 is received. The illustrated clamping element 23 is an elastic element that is biased in the support element 21, configured as a groove, in such a manner that said clamping element 23 has a curvature. This curvature bears on the wall of the feed-dog holder 30 (not illustrated here) such that the spacing of the feed dog 10 from the feed-dog holder 30 is establishable by way of the curvature radius of the clamping element 23.

Figure 14:
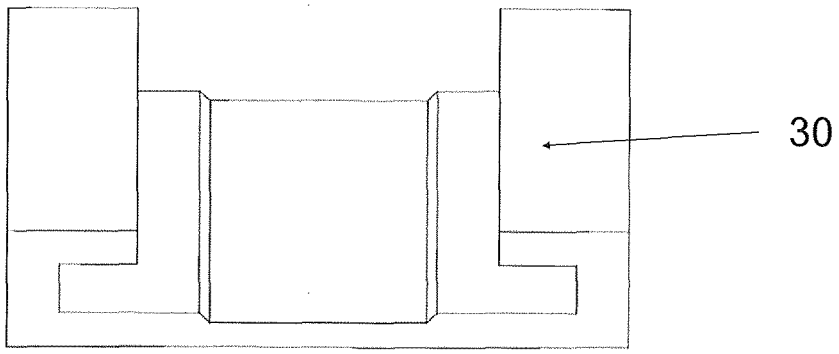
FIG. 14 shows a perspective view of the rail according to FIG. 12.

FIG. 14 shows a view of the feed-dog holder 30 that is associated with the exemplary embodiment according to FIG. 13. The feed-dog holder 30 has a C-shaped cross section. In the present exemplary embodiment, one groove is configured by each of the legs of the "C", a support element 21, as is shown in FIG. 12 or FIG. 13, being received in said groove. Each of the clamping elements 22, 23 is an elastic element which in the clearance is biased in such a manner that said elastic element has a curvature. An arc that bears on the wall of the feed-dog holder 30 is configured by this curvature, such that the feed dog 1 is establishable in the feed-dog holder 30 by way of the contact pressure of the clamping element 22, 23.

FIG. 15 shows a view of a sewing machine 101. The sewing machine 101 has a machine head 107 having a sewing device. The machine head 107 is disposed at the end of an upper arm 105. An upright element 102 adjoins the other end of the upper arm 105. A so-called arm bed 103 is disposed below the upper arm 105, so as to run substantially parallel with the upper arm 105. The arm bed 103 at one end is connected to the upright element 102. The arm bed 103 serves as a support for the sewn product 115. The machine head 107 contains a needle 111 which is moved up and down and periodically comes into contact with the sewn product 115. A needle thread 120 is guided in the sewing needle 111. The sewing needle 111 pierces the sewn product 115, the needle thread 120 herein being connected to a bobbin thread 116 that is located below the sewn product 115, on account of which a seam or a pattern is generated. The sewing needle 111 is releasably connected to a needle holder which is disposed at a lower end of a needle bar 109. The needle bar 109 is moved up and down by a needle-bar drive. The needle bar 109 is thus movable up and down in the direction of the needle-bar axis A, in order to carry out sewing stitches, this being symbolized by the double arrow A'. In order for zigzag stitches to be carried out, the needle bar 109 is mounted in the machine head 107 so as to be additionally pivotable about a pivot axis B, in a manner transverse to the sewing direction N, or in the longitudinal direction of the upper arm 105, respectively, this potentially being symbolized by the double arrow B'. The machine head 107 furthermore contains a presser-foot bar which has a tapered or truncated-tapered extending lower end for coupling and fastening various presser feet. The presser-foot bar is not shown in the present illustration. Dissimilar presser feet are employed, depending on the type of sewing jobs to be carried out. At the commencement of the job, the presser-foot bar together with the presser foot is lowered such that the sole of the presser foot bears on the sewn product 115. In this position, the sewn product 115 is located on the needle-hole plate 113 between the feed dog 10 and the sole of the presser foot such that the location at which a needle stitch is to take place is precisely defined. The sewn product 115, prior to the next stitch being performed, may be displaced to the correct position by the feed dog 10 such that a continuous seam or a continuous needle pattern may be generated in this way. The feed dog 10 thus serves for ensuring that the sewn product 115 is indexed. Alternatively, the sewn product 115 may be clamped in an embroidery frame. The embroidery frame may be moved in the X-direction or the Y-direction, respectively, in a plane that contains the sewn product 115, such that the next piercing location of the sewn product 115 comes to lie below the sewing needle 111. The embroidery frame may be moved by a control element which may be a component part of the sewing machine or may be coupled to an external computer. Of course, the sewn product 115 may also be manually displaced across the support plane that is configured by the needle-hole plate and the surface of the arm bed 103 that adjoins said needle-hole plate. This operating mode is employed for darning or quilting, for example.

The needle-hole plate 113 comprises an elongate hole 114 through which the lower portion of the sewing needle 111, having pierced the sewn product 115 that is located on the needle-hole plate 113, may be guided into the forward region of the lower arm 103 during sewing. This means that the lower portion of the sewing needle at times protrudes into the interior of the arm bed 103, therefore being located below the needle-hole plate 113. In this position, the bobbin thread 116 may be encompassed by the sewing needle 111 and be linked to the needle thread 120 that is guided by the eyelet 129 of the sewing needle 111 in such a manner that a seam may be configured on the sewn product 115.

Figure 16:
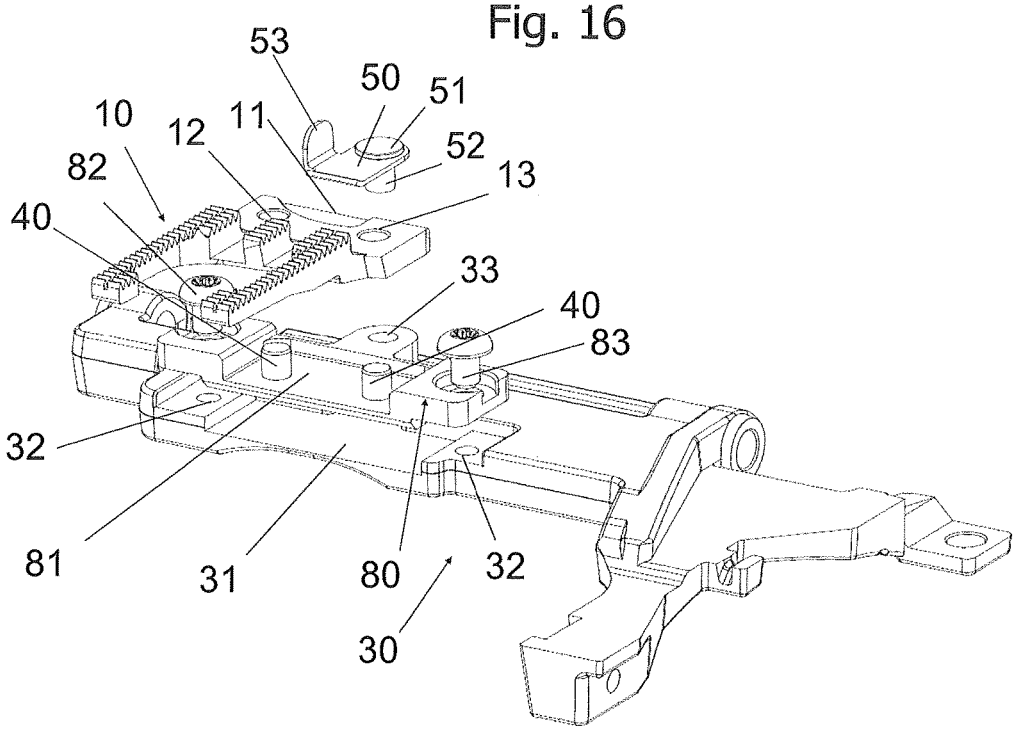
FIG. 16 shows a perspective illustration of a fourth exemplary embodiment according to the invention, in an exploded illustration.

FIG. 16 shows a perspective illustration of a fourth exemplary embodiment according to the invention, in an exploded illustration. The device for manually changing a feed dog 10 for a sewing machine, according to FIG. 16, comprises the feed dog 10 and a feed-dog holder 30. The feed dog 10 is receivable in a clearance 31 of the feed-dog holder 30. The feed-dog holder 30 is disposed in an arm bed 103 of the sewing machine 101, as is shown in FIG. 15. The feed dog 10 is fastenable in a clearance 81 of an insert element 80 by a fastening element 40, wherein the fastening element 40 is releasably held in the insert element 80. The fastening element 40 may be configured as a bolt, for example. According to the embodiment in FIG. 16, various feed dogs 10 may be fastened in the insert element 80 by way of two fastening elements 40. The insert element 80 is received in the feed-dog holder 30. The insert element 80 is received in a clearance 31 of the feed-dog holder 30. The insert element 80 is held in the feed-dog holder 30 by one or a plurality of fastening elements 82, 83.

Figure 19:
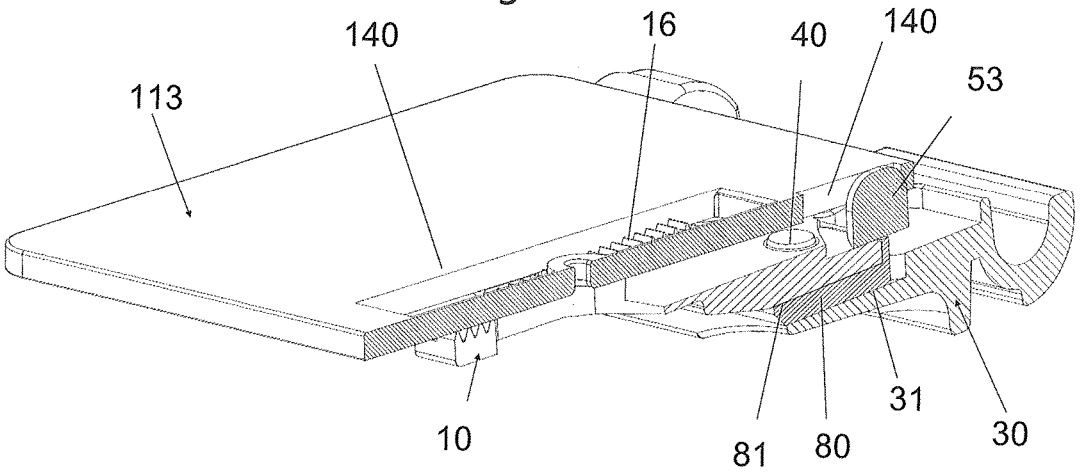
FIG. 19 shows a section through the feed dog according to FIG. 16, in the installed state.

A setting element 50 by way of which the feed dog 10 in the position thereof in relation to the clearance 31 and/or to the insert element 80 is settable is also illustrated in FIG. 16. The setting element 50 according to FIG. 16 is configured as a pin which has a head end 51 and a neck 52. The head end 51 has a larger diameter than the neck 52. The neck 52 may have an external thread. The neck 52 may at least partially be held in a bore 33 that is attached in the clearance 31 or the clearance 81. The bore 33 may be configured as a threaded bore. The setting element 50 may contain a locking element 53. The locking element 53 serves for locking in relation to the needle-hole plate 113 which is not shown in FIG. 16. The locking element 53 according to the present exemplary embodiment is configured as an L-shaped tab. The lower leg of the "L" in the installed state is in particular vertically aligned and protrudes into a respective clearance of the needle-hole plate 113, as is shown in FIG. 19. The insert element 80 serves for the alignment of the feed dog. The insert element 80 ex-works is loosely screw-fitted, the feed dog 10 is inserted and is merely held by the setting element 50 which is configured as a locking element or a holding element, for example. Once the feed dog 10 has been aligned by way of the insert element 80, the latter is tightly screwed to the feed-dog holder 30.

The neck 52 may also be configured without an interference fit, that is to say with play, or may be held in the threaded bore 33 by a shaft lock-down device, for example a Benz pin (not shown), wherein a plain bore instead of a threaded bore may be provided. The alignment is not performed by way of an eccentric feature. Both fastening elements 40 are preferably embodied as interference-fit bolts, this is to say without play.

As is the case in FIG. 1, the setting element 50 may contain an eccentric disk, or the head end 51 may be configured as an eccentric feature, this being illustrated in the embodiment according to FIG. 20, for example. The head end 51 may have a receptacle element for an activation key. According to one further exemplary embodiment, the head end 51 may have a rough profile or a fluted feature, enabling the head end 51 to be manually rotated so as to move the locking element 53 to the desired position, on account of which establishing the feed dog 10 in relation to the needle-hole plate 113 may be performed. The tab may also serve as a handle or a lever element for moving the setting element to the desired position. The feed dog 10 may thus be aligned so as to correspond to the contour that is located in the needle-hole plate 113 of the sewing machine 101. A needle-hole plate 113 of this type is shown in a partially fragmented view in FIG. 19, for example.

If and when two fastening elements 40 are used, one of the fastening elements 40 may be received without play, that is to say by way of an interference fit, in the bore 12 of the feed dog 10, and the respective other fastening element 40 may be received without an interference fit, that is to say with play, in the associated bore 13 of the feed dog 10.

A fixing element which may be configured as a magnetic element, in particular as a magnetic pin, for example, may be used for fixing the feed dog 10 and/or the insert element 80 in the correct position, prior to the blocking of the feed dog 10 being performed by the fastening element or elements 40, or prior to the blocking of the insert element 80 being performed by the fastening elements 82, 83.

Figure 17:
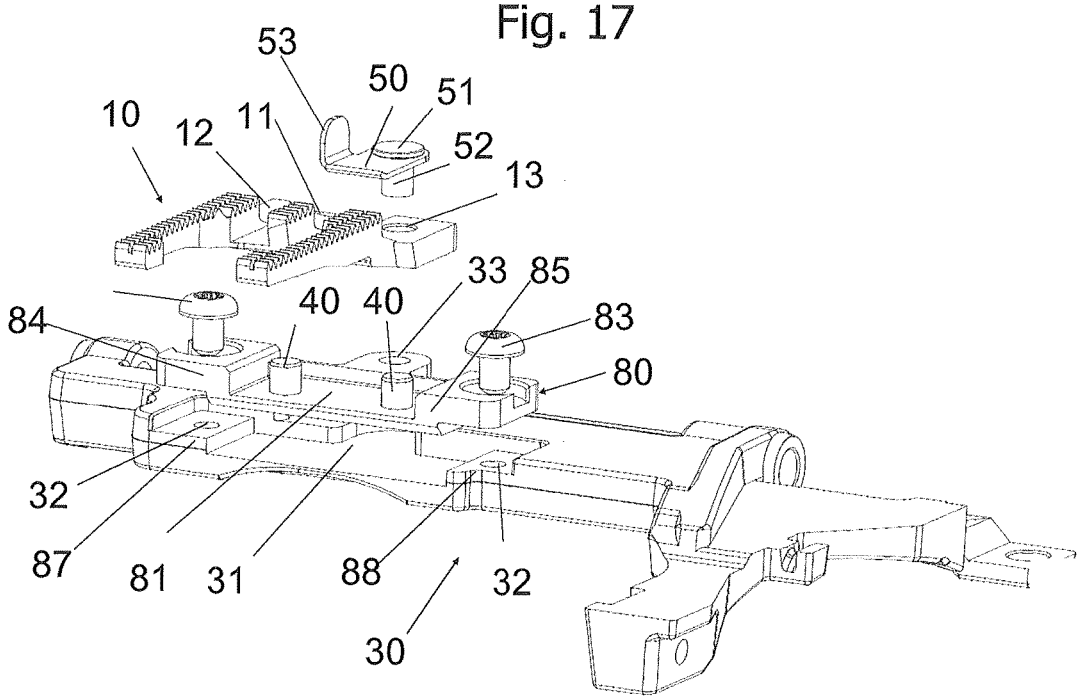
FIG. 17 shows a further perspective illustration of a fourth exemplary embodiment according to the invention, in an exploded illustration according to FIG. 16.

FIG. 17 shows a further perspective illustration of a fourth exemplary embodiment according to the invention, in an exploded illustration, according to FIG. 16. The insert element 80 which has a first ledge 84 and a second ledge 85 is shown in FIG. 17. The bores 32 for the fastening elements 82, 83 are provided in the ledges 84, 85. The lateral flanks of the feed dog 10 bear on the internal edges of the ledges 84, 45. One ledge 87, 88 each may likewise be disposed in the clearance 31 of the feed-dog holder 30. The external edges of the ledges 84, 85 bear on the ledges 87, 88 of the feed-dog holder 30, if and when the insert element 80 is fastened to the feed-dog holder 30.

Figure 18:
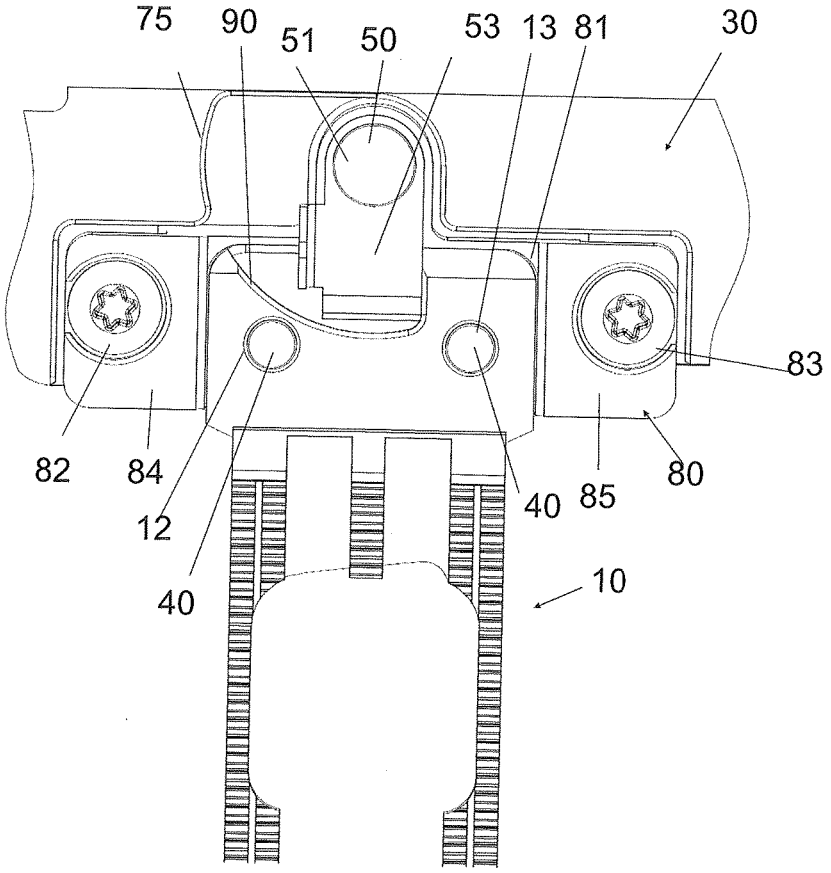
FIG. 18 shows a view of the feed dog in FIG. 16, in the installed state.

FIG. 18 shows a view of the feed dog 10 in FIG. 16, in the installed state, with the needle-hole plate 113 removed. The feed dog 10 is inserted into the insert element 80 which in turn is inserted into the feed-dog holder 30. The insert element 80 is connected to the feed-dog holder 30 by the fastening elements 82, 83. It is shown in FIG. 18 that the spacing between the ledges 84, 85 of the insert element 80 corresponds exactly to the width of the feed dog 10, such that the feed dog 10 may be precisely held in the clearance 81. Two fastening elements 40 of identical type extend from the internal base of the insert element 80 through the respective bores 12, 13 of the feed dog 10. Due to this, the position of the feed dog 10 in the X-direction may be fixed. The position of the insert element in the X-direction and in the Y-direction is established by the fastening elements 82, 83. If and when the lateral flanks of the feed dog 10 are fitted accurately between the internal flanks of the ledges 84, 85, the position of the feed dog 10 in the X-direction is also established. If and when at least one of the bores 12, 13 is configured as bore with play, the position of the feed dog 10 in the Y-direction may still be variable. Therefore, the position of the feed dog 10 in the Y-direction may be established by the setting element 50. To this end, the locking element 53 may be located in the locking position that is shown in FIG. 18. The locking element 53 may be configured so as to be integral with the head end 51 and/or the neck 52; said locking element 53 may however also be disposed so as to be rotatable about a locationally fixed neck. The feed dog 10 may have a respective clearance 90 which is specified for engaging the locking element 53. An unlocking clearance 75 for receiving the locking element 53 in the unlocked position thereof, for example, if and when the feed dog 10 is being replaced by another feed dog, may be provided in the feed-dog holder 30.

FIG. 19 shows a section through the feed dog 10 according to FIG. 16, in the installed state, in a perspective illustration. The feed dog 10 bears on the support face that is formed by the clearance 81 of the insert element 80. The insert element 80 bears on the clearance 31 that is formed by the feed-dog holder 30. Only part of the locking element 53, specifically part of the tab which protrudes through a respective opening in the needle-hole plate 113, is visible of the setting element 50. FIG. 19 also shows an opening in the needle-hole plate for one of the feed-dog arms, specifically for the external web 16. The second feed-dog arm, that is to say the external web 17 according to FIG. 5, is not visible in the present illustration, since said external web 17 lies in front of the sectional plane. The locking element 53 is configured in combination with the needle-hole plate 113 such that the locking element 53 engages in the clearance of the needle-hole plate 113 only once the locking action has been completely activated, such that it is guaranteed that the needle-hole plate 113 cannot be fitted in the case of an incomplete locking action.

FIG. 20 shows a perspective illustration of a fifth exemplary embodiment according to the invention, in an exploded illustration. The device for manually changing a feed dog 10 for a sewing machine, according to FIG. 20, comprises the feed dog 10 and a feed-dog holder 30. The feed dog 10 is receivable in a clearance 31 of the feed-dog holder 30. The feed-dog holder 30 is disposed in an arm bed 103 of the sewing machine 101, as is shown in FIG. 15. The feed dog 10 is fastenable in a clearance 81 of an insert element 80 by a fastening element 40, wherein the fastening element 40 may be releasably held in the insert element 80. The fastening element 40 may be configured as a dovetail groove, for example. One lateral flank of the feed dog 10 may be push-fitted in each case into this dovetail groove. The width of the feed dog 10 in the region of the lateral flanks may increase from the upper side, that is to say that side that during operation comes into contact with the sewn product, toward the opposite side, that is to say the lower side in the drawing. Due to this, the feed dog 10 is captively held in the insert element. According to the embodiment in FIG. 20, various feed dogs 10 may be fastened in the insert element 80 by way of two fastening elements 40. The dovetail groove may have flanks that form part of a cone, the tip of the latter pointing in the direction of the webs 16, 17, 18 of the feed dog 10. The feed dog 10 may be centered in the dovetail groove by way of a conical embodiment of the dovetail groove.

The insert element 80 is received in the feed-dog holder 30. The insert element 80 is received in a clearance 31 of the feed-dog holder 30, in particular. The insert element 80 is held in the feed-dog holder 30 by one or a plurality of fastening elements 82, 83. The alignment of the feed dog is performed ex-works by way of the insert element 80. The setting element 50 serves only as a locking feature. The setting element 50 may also in the case of this embodiment be held in the bore by way of a fit with play, or by way of a securing bolt.

A setting element 50, by way of which the feed dog 10 in the position thereof in relation to the clearance 31 and/or to the insert element 80 is settable, is also illustrated in FIG. 20. The setting element 50 according to FIG. 20 is configured as a lever element which has a head end 51 and a neck 52. The head end 51 has a larger diameter than the neck 52. The neck 52 may have an external thread. The neck 52 can at least be partially held in a bore 33 that is attached in the clearance 31 or the clearance 81. The bore 33 may be configured as a threaded bore. The setting element 50 may contain a locking element 53. The locking element 53 serves for locking in relation to the needle-hole plate 113 that is not shown in FIG. 20. The locking element 53 according to the present exemplary embodiment is composed of the head end 51 which is in contact with a spring element that is attached to the feed dog 10, if and when the feed dog 10 is located in the installed position thereof.

The feed dog is locked in the installed position in that the lever element of the setting element 50 is moved to a position in which the head end 51 presses onto the spring element 19 that is shown in FIG. 21, biasing the latter. The setting element 50 contains a detent 57 that in the installed state is in particular vertically aligned and protrudes into a respective opening 140 of the needle-hole plate 113, as is shown in a similar manner in FIG. 19 for the tab of the locking element 53.

The spring element 19 may be inserted into the feed dog 10, that is to say be configured as an inlay element, or said spring element 19 may be configured as a component part of the feed dog 10. In particular, the spring element may be manufactured from the base material by way of a locally acting material-treatment method, for example by hardening, zone-melting, tempering, radiation, or other methods that are known to a person skilled in the art for modifying the microstructure of the material of the feed dog in a localized manner.

As in FIG. 1, the setting element 50 may contain an eccentric disk, or the head end 51 could be configured as an eccentric feature, as is illustrated in FIG. 20 or FIG. 21. The head end 51 may have a receptacle element for an activation key. According to one further exemplary embodiment, the head end 51 may have a rough profile or a fluted feature, enabling the head end 51 to be manually rotated so as to move the locking element 53 to the desired position, on account of which establishing the feed dog 10 in relation to the needle-hole plate 113 may be performed. The tab or detent 57 may also serve as a handle or gripping element for a tool for moving the setting element 53 to the desired position.

The feed dog 10 may thus be aligned depending on the contour that is located in the needle-hole plate 113 of the sewing machine 101. A needle-hole plate 113 of this type is shown in a partially sectional view in FIG. 19, for example. In particular, it may be avoided by way of this fine adjustment that the feed dog 10 during operation comes into contact with an edge of the needle-hole plate 113, and that the feed dog 10 or the needle-hole plate 113 may be damaged. In particular, the needle-hole plate may have an opening 140 that is generated by a milling method, for example. The needle-hole plate 113 may only be fitted upon complete locking of the feed dog, since the detent 57 only fits into the opening 140 in this instance.

If and when two fastening elements 40 are used, the feed dog may be received in one of the fastening elements 40 without play, that is to say by way of an interference fit, and may be received in the respective other fastening element 40 without an interference fit, that is to say with play. In particular in the case of the configuration of the fastening element as a dovetail groove, a movement of the feed dog in the X-direction and in the Z-direction may be prevented. The movement in the Y-direction, according to the exemplary embodiment that is illustrated in FIGS. 20, 21, may be prevented by bracing the spring element 19 by the setting element 50.

A fixing element which may be configured as a magnetic element for example, in particular as a magnetic pin, may be used for fixing the feed dog 10 and/or the insert element 80 in the correct position before blocking of the feed dog 10 is performed by the fastening element or elements 40, or before blocking of the insert element 80 by the fastening elements 82, 83 is performed, respectively.

One advantage of this exemplary embodiment lies in that a precise alignment of the feed dog is enabled both in the X-direction as well as in the Y-direction by fastening elements which are configured as form-fitting guide elements for the feed dog, such as a dovetail groove for a respective flank of the feed dog, for example. In particular, the web elements 16, 17, 18 of the feed dog are aligned so as to be parallel with the Y-axis, that is to say that said web elements are aligned exactly in the indexing direction of the sewn product. The alignment in the X-direction, that is to say in the longitudinal direction of the arm bed 103, is performed exactly in relation to the respective clearance or the respective clearances in the needle-hole plate 113.

Figure 22:
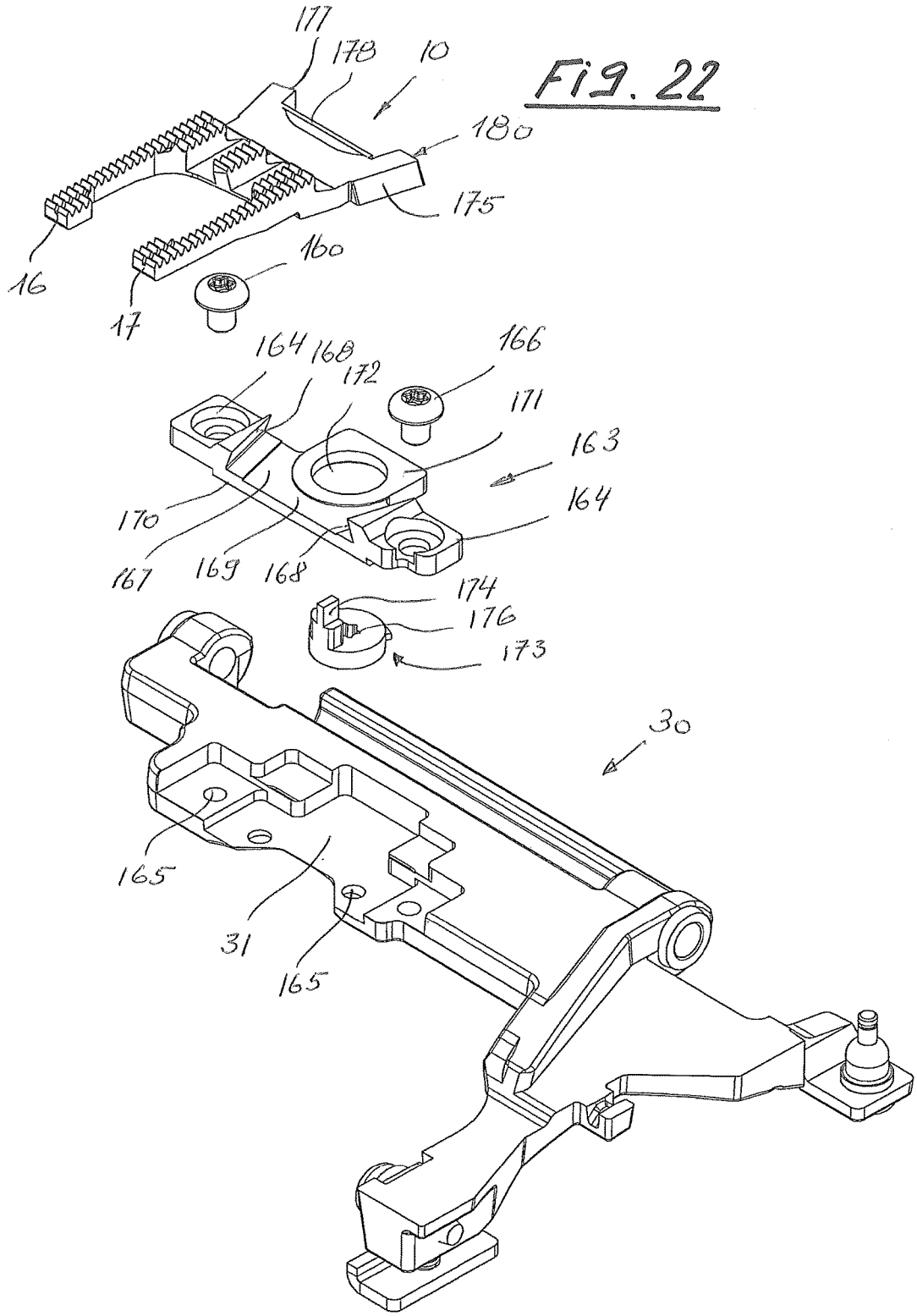
FIG. 22 shows a perspective illustration of a sixth exemplary embodiment according to the invention of a feed-dog holder, in an exploded illustration.

It can be seen in FIG. 22 that the clearance 31 in the feed-dog holder 30 has a contour which differs from that of the preceding exemplary embodiments. It is not the feed dog 10 that is placed into the clearance 31, but a fastening element 163. The fastening element 163 laterally comprises in each case one bore 164, said bores 164 being configured so as to be coaxial with threaded bores 165 in the clearance 31 on the feed-dog holder 30. The fastening element 163 is fastened ex-works by way of two screws 166, for example hexagon socket screws, to the feed-dog holder 30, and ex-works is already adjusted in such a manner that each of the feed dogs 10 that are placed into the fastening element 163 are later always held in the definite operating position.

A tapered extending dovetail groove 167 is configured in the fastening element 163, the two flanks 168 of said dovetail groove 167 which are oblique in relation to the surface of the fastening element 163 mutually running at an acute angle. A planar face 169 which is parallel to the lower side 170 of the fastening element 163 is configured between the two flanks 168, said fastening element 163 coming to bear on the base of the clearance 31.

A lug 171 that protrudes to the rear in FIG. 22 is configured in the planar face 169, a circular opening 172 or a blind bore being disposed in the center of said lug 171. A disk 173 having an eccentrically disposed latching cam 174 that protrudes beyond the end face of the disk 173 fits into the opening 172. An engagement 176 for a rotating tool for a Torx screwdriver or a hexagon screw driver or the like is configured in the center of the disk 173.

Figure 23:
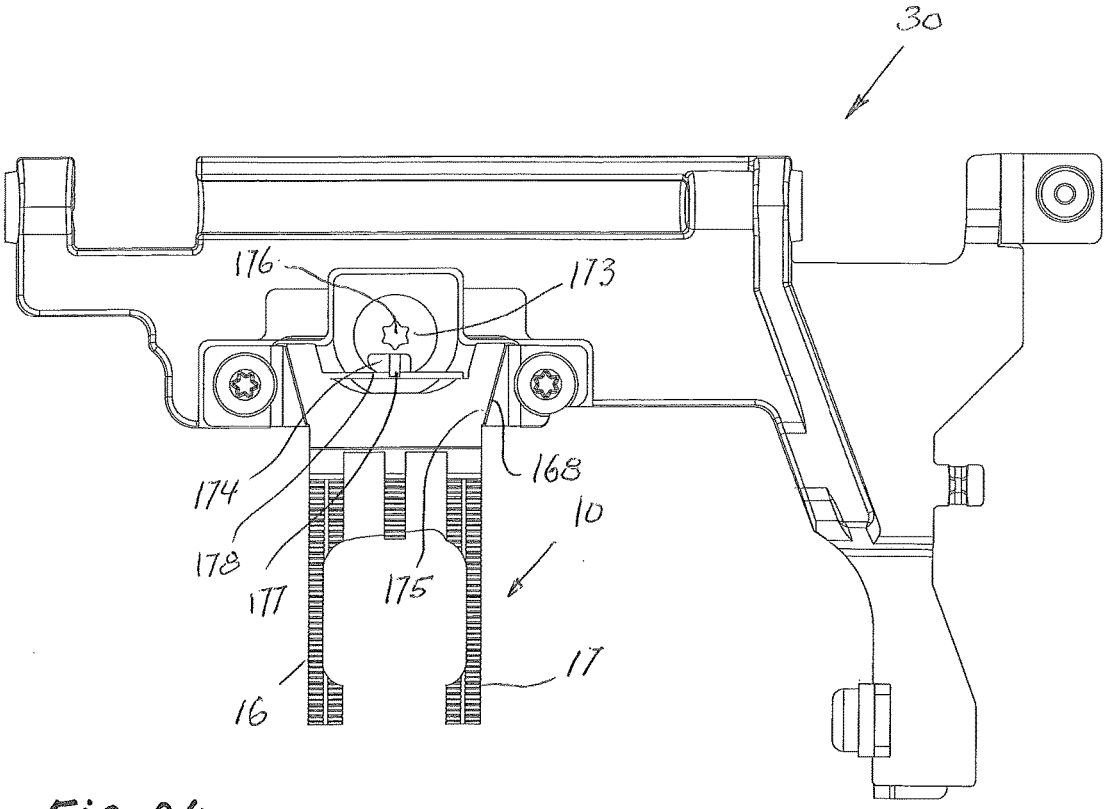
FIG. 23 shows a plan view of the exemplary embodiment according to FIG. 23 (individual parts assembled)

The feed dog 10, which is disposed on the fastening element 163, as in the preceding exemplary embodiments comprises two webs 16, 17 that run so as to be substantially parallel, having teeth attached thereto and on the rear side a dovetail connection 180. The latter comprises two faces 175 which are at an acute angle in relation to one another and at an acute angle in relation to the lower side of the feed dog 10. The faces 175 in spatial terms are disposed in such a manner that said faces 175 in the dovetail groove 167 bear without play on the feed-dog holder 30 and hold the feed dog 10 so as to be guided without play in the push-fitted position (cf. FIG. 23). Furthermore, a notch 177 is configured on the feed dog 10 in FIG. 22, said notch 177 being traversed by an elastic web 178, for example a leaf spring. As can be seen in FIG. 23, the elastic web 178 can be part of the feed dog 10 or be fastened to the latter.

The latching cam 174 on the disk 173 in FIG. 23 bears on the web 178 and thus pushes the feed dog 10 into the dovetail groove 167 on the fastening element 163. The fastening element 163 in the assembly of the sewing machine has been aligned ex-works in a non-recurring manner such that in the case of the feed dog 10 being changed and replaced by a feed dog 10 having other dimensions, the position upon push-fitting of the feed dog 10 into the dovetail groove 167 is at all times exactly true.

Figure 24:
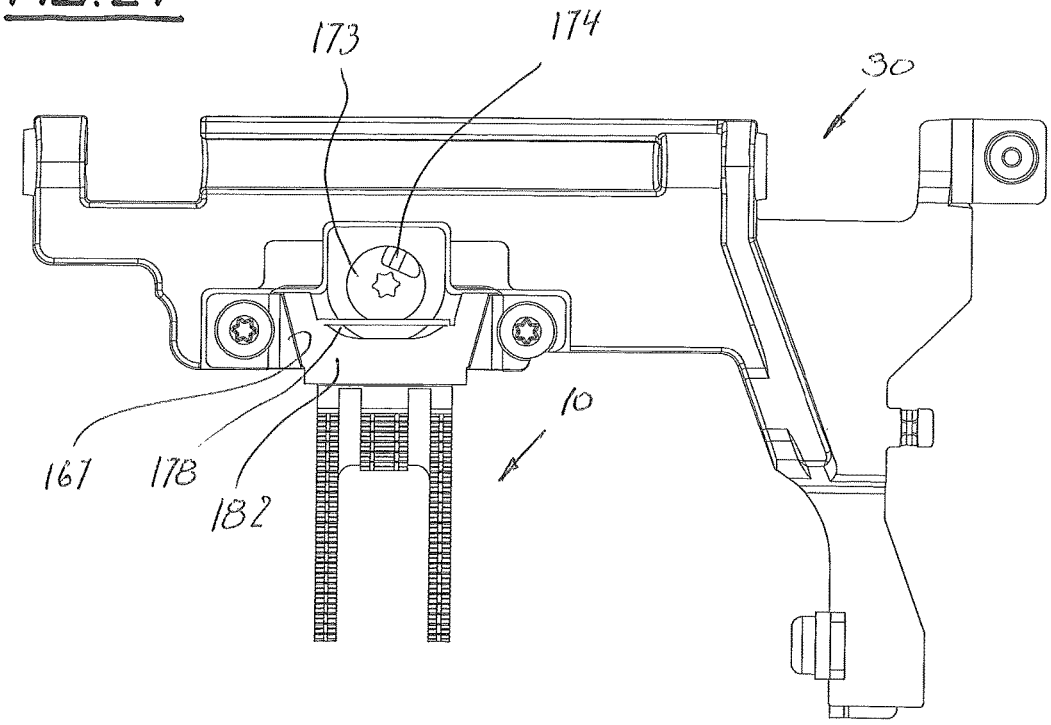
FIG. 24 shows a plan view of the feed-dog holder as in FIG. 23, however equipped with a narrow feed dog.

In order for the feed dog 10 to be able to be replaced by another feed dog 10, the disk 173 by way of a rotating tool in the engagement 176 is rotated, for example by approx. 180°, such that the latching cam 174 comes to lie so as to be remote from the spring-elastic web 178. The feed dog 10 can now be moved out of the tapered extending dovetail groove 167 (cf. FIG. 24), whereby the feed dog 10 indeed still bears in the dovetail groove 167 but is no longer held in a secured manner by the latching cam 174. In FIG. 24, a feed dog 10 having webs 16, 17 which are closer together has already been push-fitted.

The latching cam 174 protrudes beyond the surface 182 of the feed dog 10 and pushes against the elastic web 178 when the feed dog 10 is introduced into the dovetail groove 167 and is held by the latching cam 174. If the disk 173 having the latching cam 174 is not in the correct latching position according to FIG. 23, the free upper end of the latching cam 174 bears from below on the needle-hole plate 113. The needle-hole plate 113 in this case cannot be placed into the surface of the free arm 103 so as to be flush with the latter, so that the operator can visually identify that the feed dog 10 is not secured or is at least fastened so as not to be properly secured on the feed-dog holder 30. If the feed dog 10 is correctly secured, the latching cam 174 comes to rest in a slot-shaped clearance on the lower side of the needle-hole plate 113. In this state, the needle-hole plate 113 can be inserted correctly into the surface of the free arm 103.

The latching cam 174 in FIGS. 25 and 26 is provided with a ramp 183 that runs at an angle. The ramp 183 serves for deflecting a securing spring 184 that is attached to the fastening element 163 upward, that is to say in the direction of the needle-hole plate 113, when the feed dog 10 is not correctly secured on the feed-dog holder 30. This is the case in FIGS. 26 and 27, when the ramp 183 and the latching cam 174 have slid under the securing spring 184. The securing spring 184 lifted upward in this manner then impacts the lower side of the needle-hole plate 113. The needle-hole plate 113 in this case cannot be placed completely into the surface of the free arm 103 and indicates visibly to the operator that something is amiss, that is to say that the feed dog 10 is inserted so as not to be correctly secured on the feed-dog holder 30.

Figure 27:
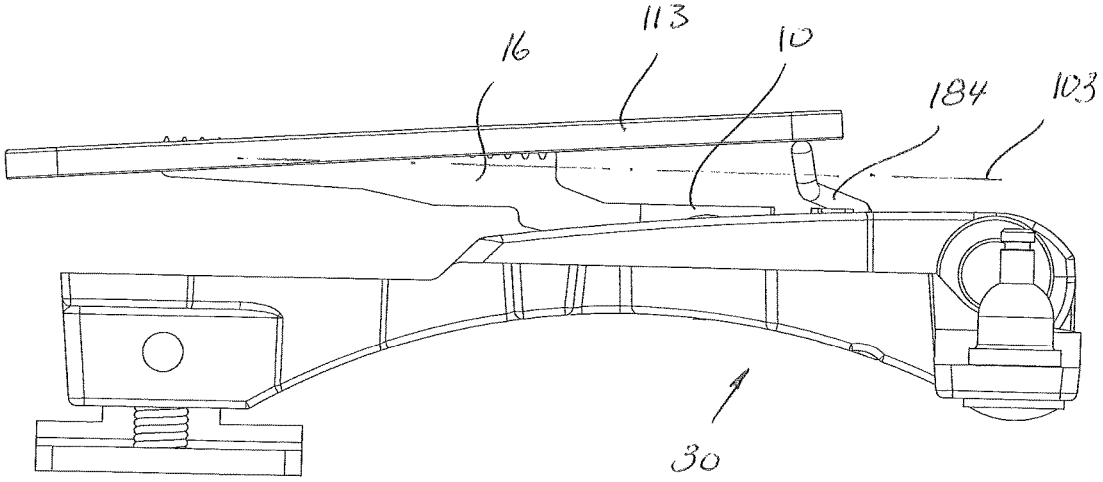
FIG. 27 shows a vertical section through the feed-dog holder along the line XXVII-XXVII in FIG. 26.

It can be seen in the cross section according to FIG. 27 that the free end of the securing spring 184 holds the needle-hole plate so as to be lifted, the latter protruding beyond the surface of the free arm 103. The surface of the free arm 103 in FIG. 27 is indicated by a chain-dotted line.

Besides ensuring a correct assembly of the feed dog 10 by mechanical measures (latching cam 174 and securing spring 184), a sensor which detects that the feed dog 10 is not correctly inserted into the feed-dog holder 30 can be attached to the needle-hole plate 113 or on the lower side of the latter. Alternatively, the sensor (not illustrated) could also establish that the needle-hole plate 113 is not correctly inserted on the face on the free arm 103.

A further possibility for establishing the locked state, or the unlocked state, respectively, can be performed visually by way of an LED which is illuminated in a punctiform manner, for example by an LED of the sewing space illumination, in that a light beam is directed to the location of the correct position or the incorrect position of the eccentric disk 173. The operator can in this way visually identify whether or not the feed dog is secured.

Alternatively to a visual indication of the locked state of the feed dog 10, the position of the needle-hole plate 113 can additionally be detected. For example, the operation of the sewing machine can be interrupted if the needle-hole plate 113 does not lie flat in the free arm.

In a further advantageous design embodiment of the invention, a marking on the various feed dogs 10 can be detected by way of a sensor, and it can thus be indicated to the operator which feed dog is currently inserted in the machine.

It is obvious to a person skilled in the art that many further modifications are possible in addition to the exemplary embodiments described, without departing from the inventive concept. The subject matter of the invention is thus not limited by the preceding description and is defined by the scope of protection that is established by the claims. The widest possible reading is relevant to the interpretation of the claims or of the description. In particular, the terms "contain" or "include" are to be interpreted in such a manner that they refer to the meaning of elements, components, or steps in a non-exclusive manner, on account of which it is to be indicated that the elements, components, or steps may be present or used such that they may be combined with other elements, components, or steps that are not explicitly mentioned. If and when the claims refer to an element or to a component from one group that may be composed of A, B, C . . . N elements or components, this wording is to be interpreted in such a manner that only one single element of this group is required and not a combination of A and N, B and N, or any other combination of two or more elements or components of this group.

LIST OF REFERENCE SIGNS

7 Feed-dog support
10 Feed dog
11 Mounting 55
12 Bore
13 Bore
15 Bearing face
16 External web
17 External web
18 Central web
19 Spring element
20 Guide element
21 Support element
22 First tensioning element
23 Second tensioning element
24 Arm element left
25 Arm element right
30 Feed-dog holder
31 Clearance
32 Threaded bore
33 Threaded bore
34 Threaded bore
35 Mounting
37 Guide rail
38 Guide rail
39 Guide rail
40 Fastening element
41 Screw
42 Screw securing feature
43 Cylinder
44 Cover face
45 Opening
46 Screw head
47 Receptacle
48 Tab
49 Screw neck
50 Setting element
51 Head end
52 Neck
53 Locking element (FIG. 16)
55 Eccentric disk
56 Readjustment screw
57 Detent
60 Threaded bolt
61 Nut
62 Threaded bolt
65 Set screw
66 Screw head
67 Screw neck
68 External thread
69 Eccentric disk
70 Holding element
71 Bore
72 Template plate
73 Snap-fit element
75 Unlocking clearance
80 Insert element
81 Clearance
82 Fastening element
83 Fastening element
84 Ledge
85 Ledge
86 Fixing element (magnetic pin)
87 Ledge
88 Ledge
90 Cut-out
101 Sewing machine
102 Upright element
103 Free arm
105 Upper arm
107 Machine head
109 Needle bar
111 Sewing needle
113 Needle-hole plate
114 Elongate hole
115 Sewn product
116 Bobbin thread (17)
117 Bobbin thread reserve
119 Bobbin capsule
120 Needle thread (21)
121 Needle thread reserve
123 Thread tensioner
125 Deflection means
127 Thread lever
129 Needle eyelet

139 Actuator
140 Opening
163 Fastening element (alignment plate)
164 Bore
165 Threaded bore
166 Screws
167 Dovetail groove
168 Flanks
169 Planar face
170 Lower side of fastening element
171 Lug
172 Opening
173 Disk
174 Latching cam
175 Face
176 Engagement
177 Notch
178 Web
180 Dovetail connection
182 Surface
183 Ramp
184 Securing spring

The invention claimed is:

1. A sewing machine, comprising a feed-dog holder (30) having a clearance (31);

a device for changing a feed dog (10) held in the clearance (31) in the feed-dog holder (30);

a feed dog (10);

a fastening element (163) inserted between the feed dog (10) and the clearance (31) in the feed dog holder (30) that is adjustably fastened on the feed-dog holder (30);

the fastening element (163) including a tapered dovetail groove (167) that is recessed in the fastening element (163); and the feed dog (10) having a dovetail connection (180) having tapered extending flanks (168) which are push-fittable into said dovetail groove (167) and fixable therein.

2. The sewing machine as claimed in claim 1, further comprising a notch (177) configured on the feed dog located on an opposite from the webs (16, 17) of said feed dog;

a spring-elastic web (178) that traverses the notch (177);

the web (178) is disposed spaced apart from a surface of the fastening element (163);

a circular opening (172) is provided in a surface of the fastening element (163);

a disk (173) is rotatably inserted in the opening (172);

a latching cam (174) configured as an eccentric is located on an end face of the disk (173), said latching cam (174) protruding axially beyond the end face; and an engagement (176) for a rotating tool is located in a center of the disk (173).

3. The sewing machine as claimed in claim 2, wherein the disk (173) is located partially below the spring-elastic web (178) and the latching cam (174) protrudes beyond an upper edge of the spring-elastic web (178).

4. The sewing machine as claimed in claim 3, further comprising a securing spring (184), and a ramp (183) for lifting a securing spring (184) is provided on the latching cam (174).

5. The sewing machine as claimed in claim 4, wherein the latching cam (174) in an arresting position bears on the spring-elastic web (178) and secures the feed dog (10), with the feed dog (10) being pushed into the dovetail groove (167).

6. The sewing machine as claimed in claim 5, further comprising a needle plate, and the latching cam (174) or the securing spring (184) in the arresting position protrudes into a clearance on a lower side of a needle-hole plate (113) in the needle plate.

7. The sewing machine as claimed in claim 1, further comprising a sensor that detects a position of the latching cam (174).

* * * * *